US006865899B2

(12) United States Patent
Nam et al.

(10) Patent No.: US 6,865,899 B2
(45) Date of Patent: Mar. 15, 2005

(54) REFRIGERATOR AND METHOD OF CONTROLLING THE SAME

(75) Inventors: Young Sok Nam, Seoul (KR); Seong Ho Cho, Seoul (KR); Yun Chul Jung, Kyunggi-do (KR); Jay Ho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 7 days.

(21) Appl. No.: 10/621,656

(22) Filed: Jul. 18, 2003

(65) Prior Publication Data

US 2004/0182105 A1 Sep. 23, 2004

(30) Foreign Application Priority Data

Mar. 22, 2003 (KR) ..... 10-2003-0017998
Mar. 22, 2003 (KR) ..... 10-2003-0017997

(51) Int. Cl.[7] ..... F25D 17/04

(52) U.S. Cl. ..... 62/187; 62/62; 62/255; 62/426

(58) Field of Search ..... 62/187, 213, 255, 62/414, 419, 426, 441, 186

(56) References Cited

U.S. PATENT DOCUMENTS 3,759,051 A * 9/1973 Ohnishi ..... 62/180
4,569,205 A * 2/1986 Dempou et al. ..... 62/155
4,646,536 A * 3/1987 Yamada et al. ..... 62/234
4,700,547 A * 10/1987 Hayashi ..... 62/65
5,081,850 A * 1/1992 Wakatsuki et al. ..... 62/405
5,343,712 A * 9/1994 Gowan ..... 62/126
5,666,819 A * 9/1997 Rockenfeller et al. ..... 62/480
5,816,054 A * 10/1998 Yoo et al. ..... 62/80

FOREIGN PATENT DOCUMENTS

FR 2460462 A * 2/1981
FR 002595549 A1 * 9/1987
JP 405018650 A * 1/1993
JP 406221739 A * 8/1994
JP 410038440 A * 2/1998
JP 410038444 A * 2/1998
JP 02002310523 A * 10/2002

* cited by examiner

*Primary Examiner*—William E. Tapolcai
*Assistant Examiner*—Mohammad M. Ali
(74) *Attorney, Agent, or Firm*—Greenblum & Bernstein, P.L.C.

(57) ABSTRACT

Disclosed herein is a refrigerator that is capable of rapidly handling a load in a freezing chamber of the refrigerator or a refrigerating chamber of the refrigerator, and preventing stored goods in a rapid cooling chamber from being excessively cooled. The present invention also provides a method of controlling such a refrigerator. The refrigerator comprises a rapid cooling chamber mounted in at least one of the freezing and refrigerating chambers, a rapid cooling channel having one end communicating with an entering channel of the refrigerating chamber and the other end communicating with the rapid cooling channel, and a damper for controlling the flow of cool air passing through the entering channel of the refrigerating chamber and the rapid cooling channel. The damper is controlled on the basis of the load in the freezing or refrigerating chamber and a load in the rapid cooling chamber.

6 Claims, 21 Drawing Sheets

REFRIGERATOR AND METHOD OF CONTROLLING THE SAME

BACKGROUND OF THE INVENTION

1. Field of the Invention

The present invention relates to a refrigerator for storing foodstuffs in a fresh and cold state and a method of controlling such a refrigerator, and more particularly to a refrigerator that is capable of sensing a load in a rapid cooling chamber of the refrigerator to control cool air supplied to the rapid cooling chamber and a method of controlling such a refrigerator.

2. Description of the Related Art

Generally, a refrigerator stores foodstuffs (hereinafter, referred to as "stored goods") in a fresh state for a long time using cool air obtained by a refrigerating cycle. The refrigerator comprises a freezing chamber for storing the stored goods at a temperature below zero, and a refrigerating chamber for storing the stored goods at a temperature above zero.

FIG. 1 is a block diagram of a conventional refrigerator showing a refrigerating cycle constituted by main components of the refrigerator.

As shown in FIG. 1, the conventional refrigerator comprises: a compressor 2 for compressing coolant to obtain high-temperature and high-pressure coolant; a condenser 4 or condensing the coolant compressed by the compressor 2 so that heat from the compressed coolant passing through the condenser 4 is emitted to air surrounding the condenser 4; an expander 6 for decompressing the liquid-phased coolant condensed by the condenser 4; an evaporator 8 for evaporating the coolant expanded by the expander 6 so that the expanded coolant passing through the evaporator 8 absorbs heat from air surrounding the evaporator 8; a blowing fan 10 for blowing the air cooled by the evaporator 8 to a freezing chamber of the refrigerator or a refrigerating chamber of the refrigerator by forced convection; a load sensing sensor 12 for sensing a load in the freezing chamber or the refrigerating chamber; and a controller 14 for comparing a value sensed by the load sensing sensor 12 with a predetermined value to control the compressor 2 and the blowing fan 10.

FIG. 2 is a schematic front view showing the interior of the conventional refrigerator, FIG. 3 is a side view showing a freezing chamber of the conventional refrigerator, and FIG. 4 is a side view showing a refrigerating chamber of the conventional refrigerator.

In the refrigerator are formed a freezing chamber F and a refrigerating chamber R, which is arranged next to the freezing chamber F, as shown in FIGS. 2 to 4. Between the freezing chamber F and the refrigerating chamber R is disposed a barrier 22, by which the freezing chamber F and the refrigerating chamber R are separated from each other. To the front part of the freezing chamber F is pivotably attached a door 24. Similarly, another door 26 is pivotably attached to the front part of the refrigerating chamber R.

The freezing chamber F is provided at the upper rear part thereof with a cool air inlet hole 27. Also, the freezing chamber F is provided at the lower rear part thereof with a cool air outlet hole 28.

The barrier 22 is provided at the upper part thereof with a cool air inlet duct 29, through which cool air is supplied to the refrigerating chamber R. Also, the barrier 22 is provided at the lower part thereof with a cool air outlet duct 30, through which cool air is discharged from the refrigerating chamber R.

In the freezing chamber F are vertically arranged a plurality of shelves 31, 32, 33, 34, and 35, which are spaced apart from each other. Similarly, another plurality of shelves 31, 32, 33, 34, and 35 are vertically arranged in the refrigerating chamber R. The shelves 31, 32, 33, 34, and 35 vertically arranged in the refrigerating chamber R are also spaced apart from each other. To the rear part of the door 24 are vertically attached a plurality of baskets 36, 37, 38, 39, and 40, which are spaced apart from each other. Similarly, another plurality of baskets 36, 37, 38, 39, and 40 are vertically attached to the rear part of the door 26. The baskets 36, 37, 38, 39, and 40 attached to the rear part of the door 26 are also spaced apart from each other.

At the top of the freezing chamber R is mounted a rapid cooling chamber S for rapidly cooling the stored goods.

The rapid cooling chamber S comprises: a rapid cooling panel 42 with an open front part, which is mounted at the top of the freezing chamber R in such a manner that the rapid cooling panel 42 communicates with the cool air inlet hole 27; and a lid 44 pivotably attached to the rapid cooling panel 42 at the front part thereof.

The operation of the conventional refrigerator with the above-stated construction will now be described.

The load sensing sensor 12 senses the temperature in the freezing chamber F or the refrigerating chamber R to output the sensed temperature to the controller 14, where the sensed temperature, which has been sensed by the load sensing sensor 12, is compared with the predetermined temperature.

When the sensed temperature is higher than the predetermined temperature, the compressor 2 and the blowing fan 10 are operated by the controller 14 (compressor and blowing fan on). When the sensed temperature is lower than the predetermined temperature, the operations of the compressor 2 and the blowing fan 10 are stopped by the controller 14 (compressor and blowing fan off).

When the compressor 2 is operated, low-temperature and low-pressure coolant passes through the evaporator 8. As the coolant passes through the evaporator 8, it absorbs heat from air surrounding the evaporator 8 by means of heat transfer between the coolant passing through the evaporator 8 and the air surrounding the evaporator 8. Consequently, the temperature of the air surrounding the evaporator 8 is lowered. The low-temperature air, i.e., the cool air surrounding the evaporator 8 is supplied to the freezing chamber F or the refrigerating chamber R by the blowing fan 10.

The cool air supplied to the freezing chamber F is introduced into the rapid cooling chamber S via the cool air inlet hole 27 to cool the interior of the rapid cooling chamber S, as shown in FIG. 3. The cool air leaving the rapid cooling chamber S is moved downwardly along the freezing chamber F to cool the stored goods in the freezing chamber F, and then returned to the evaporator 8 via the cool air outlet hole 28.

The cool air supplied to the refrigerating chamber R is introduced into the inner upper part of the refrigerating chamber R via the cool air inlet duct 29, moved downwardly along the refrigerating chamber R to cool the stored goods in the refrigerating chamber R, and returned to the evaporator 8 via the cool air outlet duct 30, as shown in FIG. 4.

As described in detail above, the rapid cooling chamber S of the conventional refrigerator is mounted on the top of the freezing chamber F in such a manner that the rapid cooling chamber S communicates with the cool air inlet hole 27. For this reason, the cool air supplied through the cool air inlet hole 27 is moved downwardly along the freezing chamber F only after it passes through the rapid cooling chamber S. Consequently, the conventional refrigerator has problems in that the load in the freezing chamber F or the refrigerating chamber R may not be rapidly handled when excessive stored goods are present in the rapid cooling chamber S, and in that the stored goods may be excessively cooled when they are stored in the rapid cooling chamber S for a long time.

SUMMARY OF THE INVENTION

Therefore, the present invention has been made in view of the above problems, and it is an object of the present invention to provide a refrigerator that is capable of rapidly handling a load in a freezing chamber of the refrigerator or a refrigerating chamber of the refrigerator, and preventing stored goods in a rapid cooling chamber from being excessively cooled.

It is another object of the present invention to provided a method of controlling a refrigerator that is capable of rapidly handling a load in a freezing chamber of the refrigerator or a refrigerating chamber of the refrigerator, and preventing stored goods in a rapid cooling chamber from being excessively cooled.

In accordance with one aspect of the present invention, the above and other objects can be accomplished by the provision of a refrigerator comprising: a compressor for compressing coolant; a condenser for condensing the coolant compressed by the compressor so that heat from the coolant passing through the condenser is emitted to air surrounding the condenser; an expander for decompressing the coolant condensed by the condenser; an evaporator for evaporating the coolant expanded by the expander so that the expanded coolant passing through the evaporator absorbs heat from air surrounding the evaporator; a blowing fan for blowing the air cooled by the evaporator to a freezing chamber of the refrigerator or a refrigerating chamber of the refrigerator and blowing the cool air in the freezing chamber or the refrigerating chamber to the vicinity of the evaporator so that the cool air is circulated in the refrigerator; a rapid cooling chamber mounted in at least one of the freezing and refrigerating chambers; a rapid cooling channel having one end communicating with an entering channel of the refrigerating chamber and the other end communicating with the rapid cooling channel; a damper for controlling the flow of cool air passing through the entering channel of the refrigerating chamber and the rapid cooling channel; a first load sensing sensor for sensing a load in the freezing chamber or the refrigerating chamber; a second load sensing sensor for sensing a load in the rapid cooling chamber; and a controller for controlling the compressor, the blowing fan, and the damper on the basis of signals outputted from the first load sensing sensor and the second load sensing sensor.

In accordance with another aspect of the present invention, there is provided a refrigerator comprising: a compressor for compressing coolant; a condenser for condensing the coolant compressed by the compressor so that heat from the coolant passing through the condenser is emitted to air surrounding the condenser; an expander for decompressing the coolant condensed by the condenser; an evaporator for evaporating the coolant expanded by the expander so that the expanded coolant passing through the evaporator absorbs heat from air surrounding the evaporator; a first blowing fan for blowing the air cooled by the evaporator to a freezing chamber of the refrigerator or a refrigerating chamber of the refrigerator and blowing the cool air in the freezing chamber or the refrigerating chamber to the vicinity of the evaporator so that the cool air is circulated in the refrigerator; a rapid cooling chamber mounted in the refrigerating chamber; a rapid cooling channel having one end communicating with the freezing chamber and the other end communicating with the rapid cooling channel; a second blowing fan for blowing the cool air in the freezing chamber to the rapid cooling chamber; a first load sensing sensor for sensing a load in the freezing chamber or the refrigerating chamber; a second load sensing sensor for sensing a load in the rapid cooling chamber; and a controller for controlling the compressor, the first blowing fan, and the second blowing fan on the basis of signals outputted from the first load sensing sensor and the second load sensing sensor.

In accordance with another aspect of the present invention, there is provided a refrigerator comprising: a compressor for compressing coolant; a condenser for condensing the coolant compressed by the compressor so that heat from the coolant passing through the condenser is emitted to air surrounding the condenser; an expander for decompressing the coolant condensed by the condenser; an evaporator for evaporating the coolant expanded by the expander so that the expanded coolant passing through the evaporator absorbs heat from air surrounding the evaporator; a blowing fan for blowing the air cooled by the evaporator to a freezing chamber of the refrigerator or a refrigerating chamber of the refrigerator and blowing the cool air in the freezing chamber or the refrigerating chamber to the vicinity of the evaporator so that the cool air is circulated ir the refrigerator; a rapid cooling chamber mounted in at least one of the freezing and refrigerating chambers; a rapid cooling channel having one end communicating with an entering channel of the refrigerating chamber and the other end communicating with the rapid cooling channel; a damper for controlling the flow of cool air passing through the entering channel of the refrigerating chamber and the rapid cooling channel; a load sensing sensor for sensing a load in the freezing chamber or the refrigerating chamber; a load-based cooling module for sensing a load in the rapid cooling chamber and supplying the cool air guided along the rapid cooling channel to the sensed load; and a controller for controlling the compressor, the blowing fan, the damper, and the load-based cooling module on the basis of signals outputted from the load sensing sensor and the load-based cooling module.

In accordance with another aspect of the present invention, there is provided a method of controlling a refrigerator, comprising: a first step of sensing a load in a freezing chamber or a refrigerating chamber of the refrigerator; a second step of sensing a load in a rapid cooling chamber mounted in the freezing chamber or the refrigerating chamber for rapidly cooling stored goods; a third step of determining whether cool air is to be supplied to the refrigerating chamber and the rapid cooling chamber on the basis of the sensed results at the first and second steps; and a fourth step of controlling a damper for controlling the flow of cool air supplying to the refrigerating chamber or the rapid cooling chamber on the basis of the determined result at the third step.

In accordance with another aspect of the present invention, there is provided a method of controlling a refrigerator, comprising: a first step of sensing a load in a freezing chamber or a refrigerating chamber of the refrigerator; a second step of sensing a load in a rapid cooling chamber mounted in the refrigerating chamber for rapidly cooling stored goods; a third step of determining whether cool air is to be supplied to the freezing or refrigerating chamber and the rapid cooling chamber on the basis of the sensed results at the first and second steps; and a fourth step of controlling a first blowing fan for blowing cool air to the freezing and refrigerating chambers and a second blowing fan for blowing cool air to the rapid cooling chamber on the basis of the determined result at the third step.

In accordance with yet another aspect of the present invention, there is provided a method of controlling a refrigerator, comprising: a first step of sensing a load in a freezing chamber or a refrigerating chamber of the refrigerator; a second step of sensing a load in a rapid cooling chamber mounted in the freezing chamber or the refrigerating chamber for rapidly cooling stored goods; a third step of determining whether cool air is to be supplied to the freezing or refrigerating chamber on the basis of the sensed result at the first step, determining whether coo air is to be supplied to the rapid cooling chamber on the basis of the sensed result at the second step, and determining the direction of supply of the cool air if it is determined that the cool air is to be supplied to any one of the freezing or refrigerating chamber and the rapid cooling chamber; and a fourth step of controlling a blowing fan for blowing cool air to the freezing and refrigerating chambers, a damper for controlling the flow of cool air supplying to the refrigerating chamber or the rapid cooling chamber, and a nozzle for supplying cool air to the rapid cooling chamber on the basis of the determined result at the third step.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
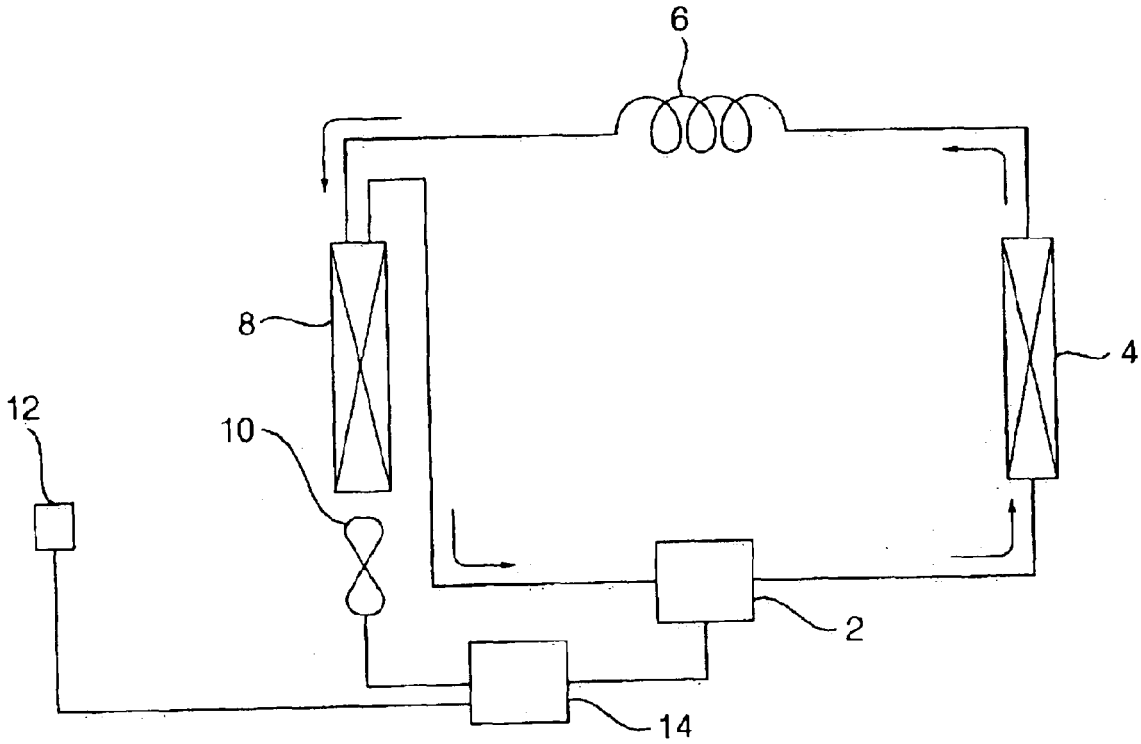
Fig. 1(Prior Art)
FIG. 1 is a block diagram of a conventional refrigerator showing a refrigerating cycle constituted by main components of the refrigerator.
Figure 2:
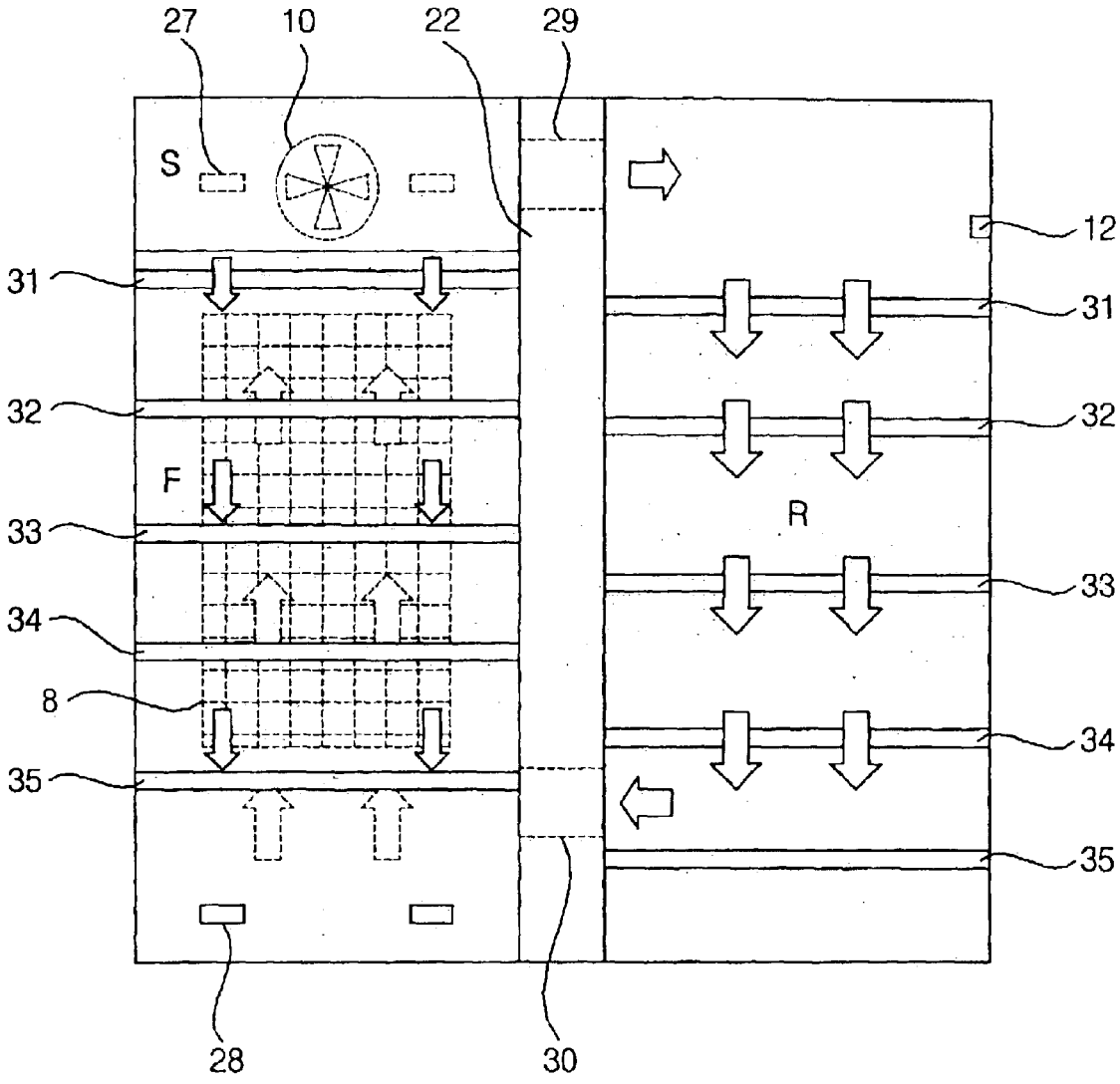
Fig. 2 (Prior Art)
FIG. 2 is a schematic front view showing the interior of the conventional refrigerator.
Figure 3:
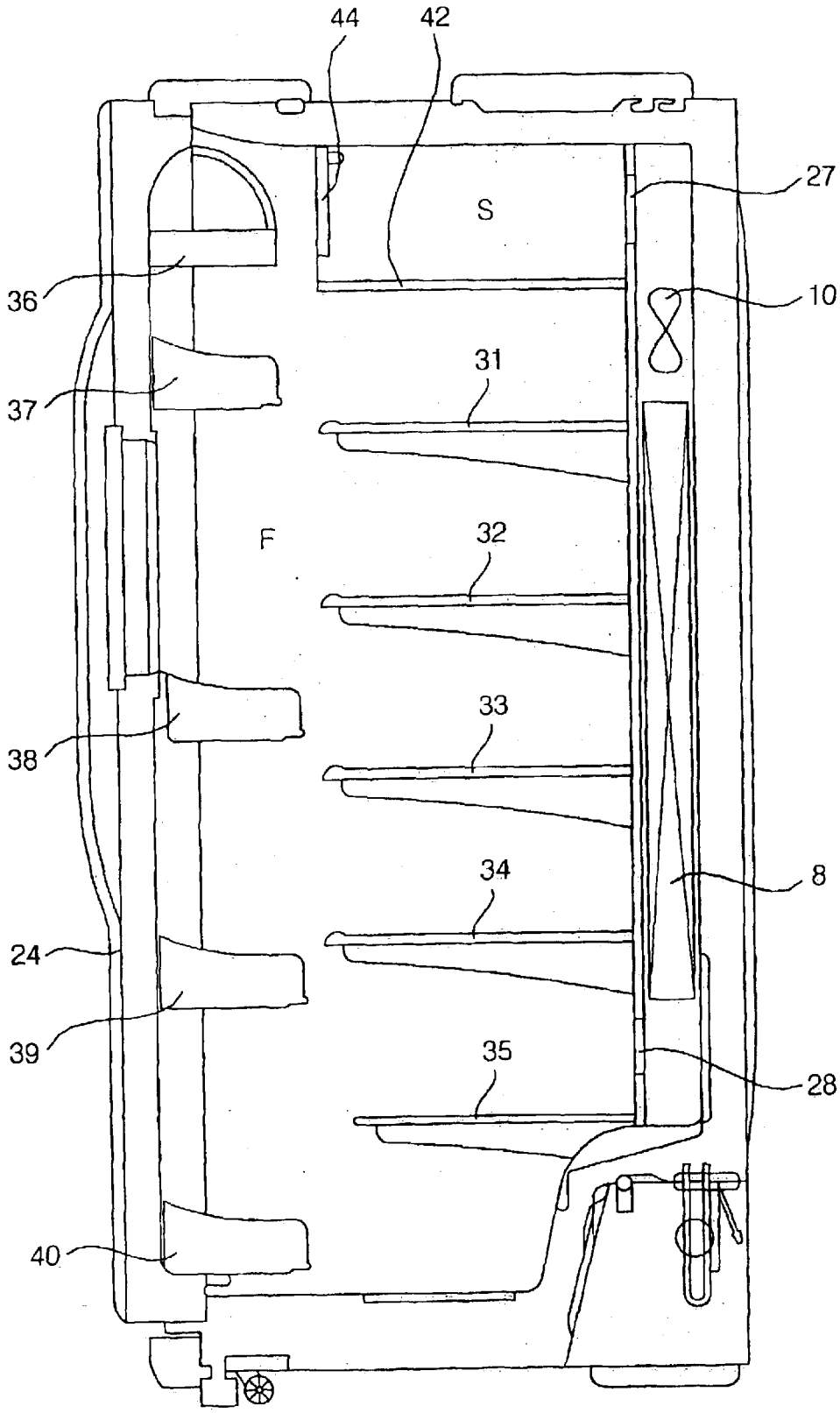
Fig. 3(Prior Art)
FIG. 3 is a side view showing a freezing chamber of the conventional refrigerator.
Figure 4:
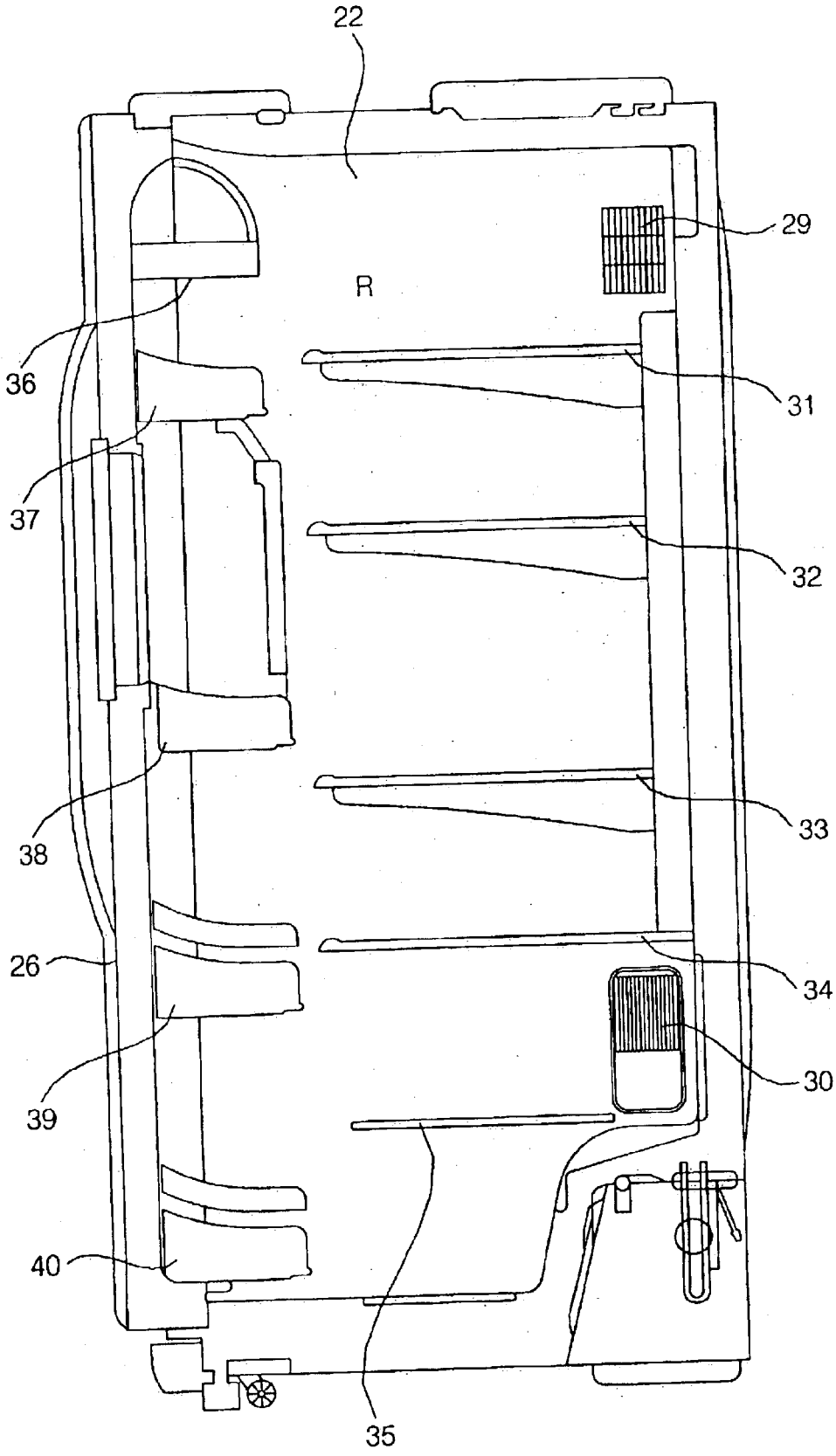
Fig. 4 (Prior Art)
FIG. 4 is a side view showing a refrigerating chamber of the conventional refrigerator.

Now, preferred embodiments of the present invention will be described in detail with reference to the accompanying drawings. In the drawings, the same or similar elements are denoted by the same reference numerals even though they are depicted in different drawings.

Figure 5:
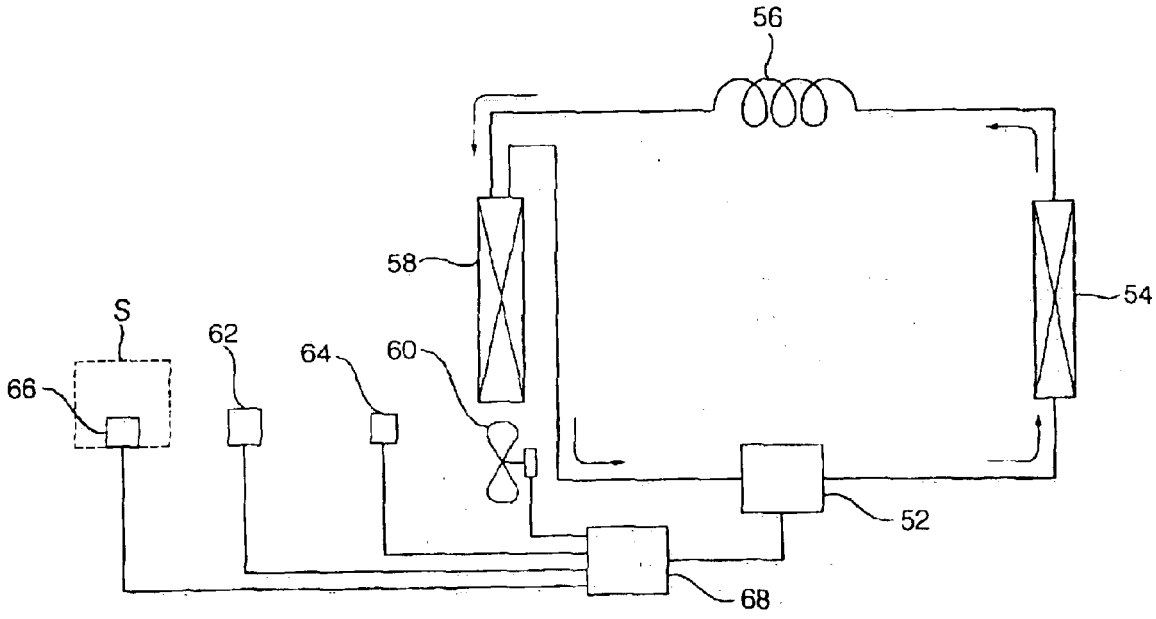
FIG. 5 is a block diagram of a refrigerator according to a first preferred embodiment of the present invention showing a refrigerating cycle constituted by main components of the refrigerator.

FIG. 5 is a block diagram of a refrigerator according to a first preferred embodiment of the present invention showing a refrigerating cycle constituted by main components of the refrigerator.

As shown in FIG. 5, the refrigerator according to the first preferred embodiment of the present invention comprises: a compressor 52 for compressing low-temperature and low-pressure gaseous coolant to obtain high-temperature and high-pressure gaseous coolant; a condenser 54 for condensing the high-temperature and high-pressure gaseous coolant compressed by the compressor 52 so that heat from the high-temperature and high-pressure gaseous coolant passing through the condenser 54 is emitted to air surrounding the condenser 54; an expander 56 for decompressing the liquid-phased coolant condensed by the condenser 54; an evaporator 58 for evaporating the coolant expanded by the expander 56 so that the expanded coolant passing through the evaporator 58 absorbs heat from air surrounding the evaporator 58; a blowing fan 60 for blowing the air cooled by the evaporator 58 to a freezing chamber of the refrigerator or a refrigerating chamber of the refrigerator and blowing the cool air in the freezing chamber or the refrigerating chamber to the vicinity of the evaporator 58 so that the cool air is circulated in the refrigerator.

In at least one of the freezing and refrigerating chambers of the refrigerator is mounted a rapid cooling chamber S for rapidly cooling stored goods. Also provided is a rapid cooling channel, along which cool air is introduced into the rapid cooling chamber S so that the stored goods in the rapid cooling chamber S are rapidly cooled regardless of a load in the freezing chamber or the refrigerating chamber.

In the refrigerator is also mounted a damper 62 for controlling the rate of supply of the cool air blown by the blowing fan 60 to the refrigerating chamber or the rapid cooling chamber S.

The refrigerator further comprises: a first load sensing sensor 64 for sensing a load in the freezing chamber or the refrigerating chamber; a second load sensing sensor 66 for sensing a load in the rapid cooling chamber S; and a controller 68 for controlling the compressor 52, the blowing fan 60, and the damper 62 on the basis of signals outputted from the first load sensing sensor 64 and the second load sensing sensor 66.

Figure 6:
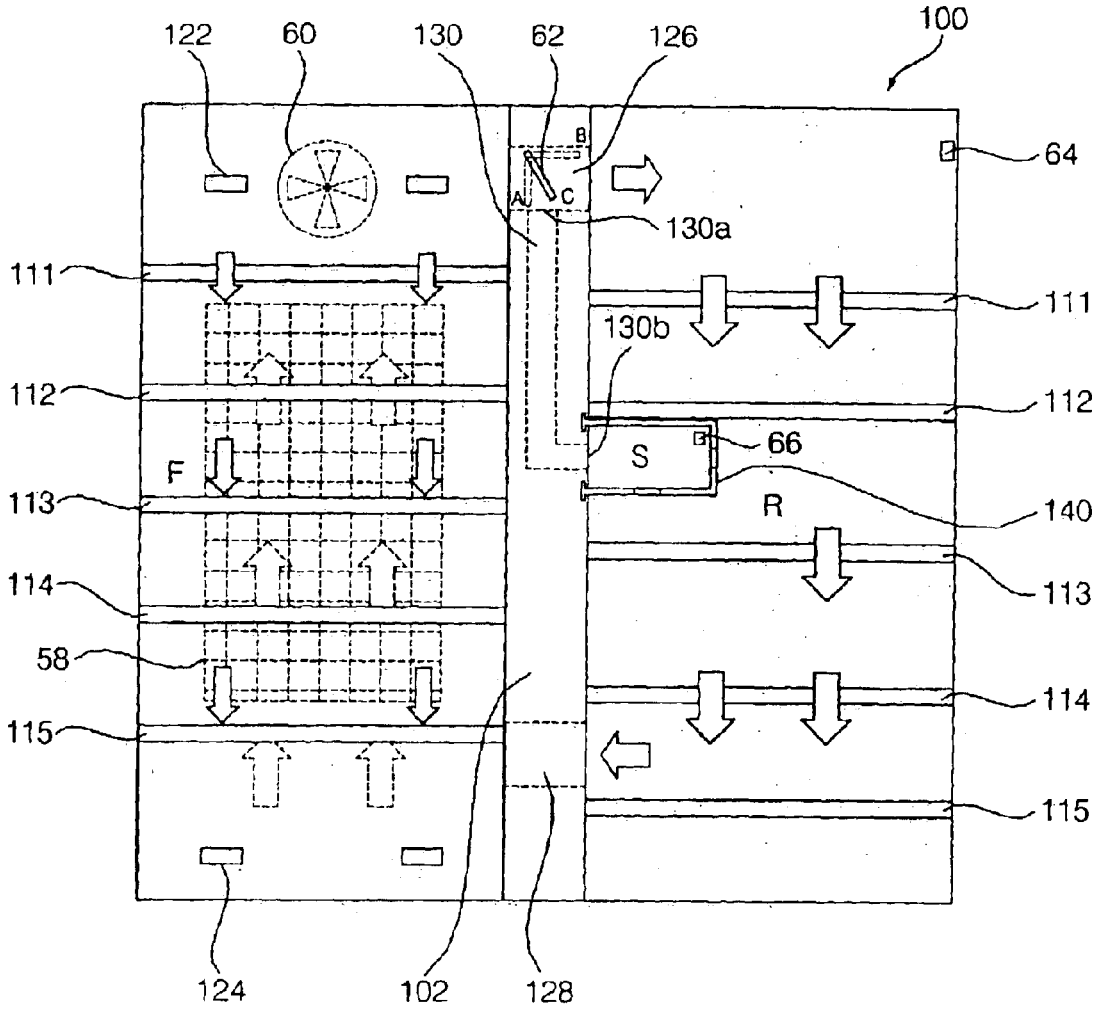
FIG. 6 is a schematic front view showing the interior of the refrigerator according to the first preferred embodiment of the present invention.
Figure 7:
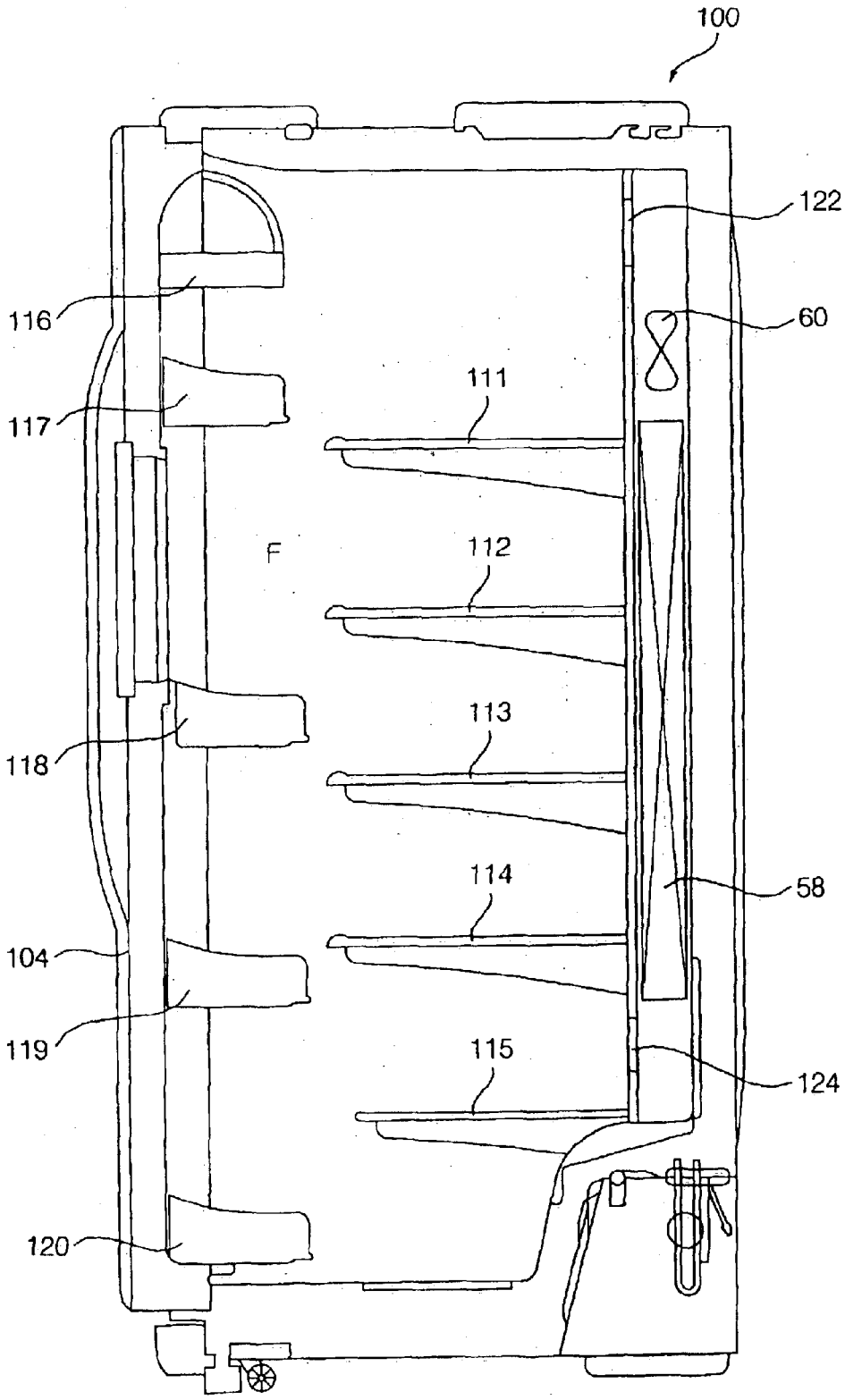
FIG. 7 is a side view showing a freezing chamber of the refrigerator according to the first preferred embodiment of the present invention.
Figure 8:
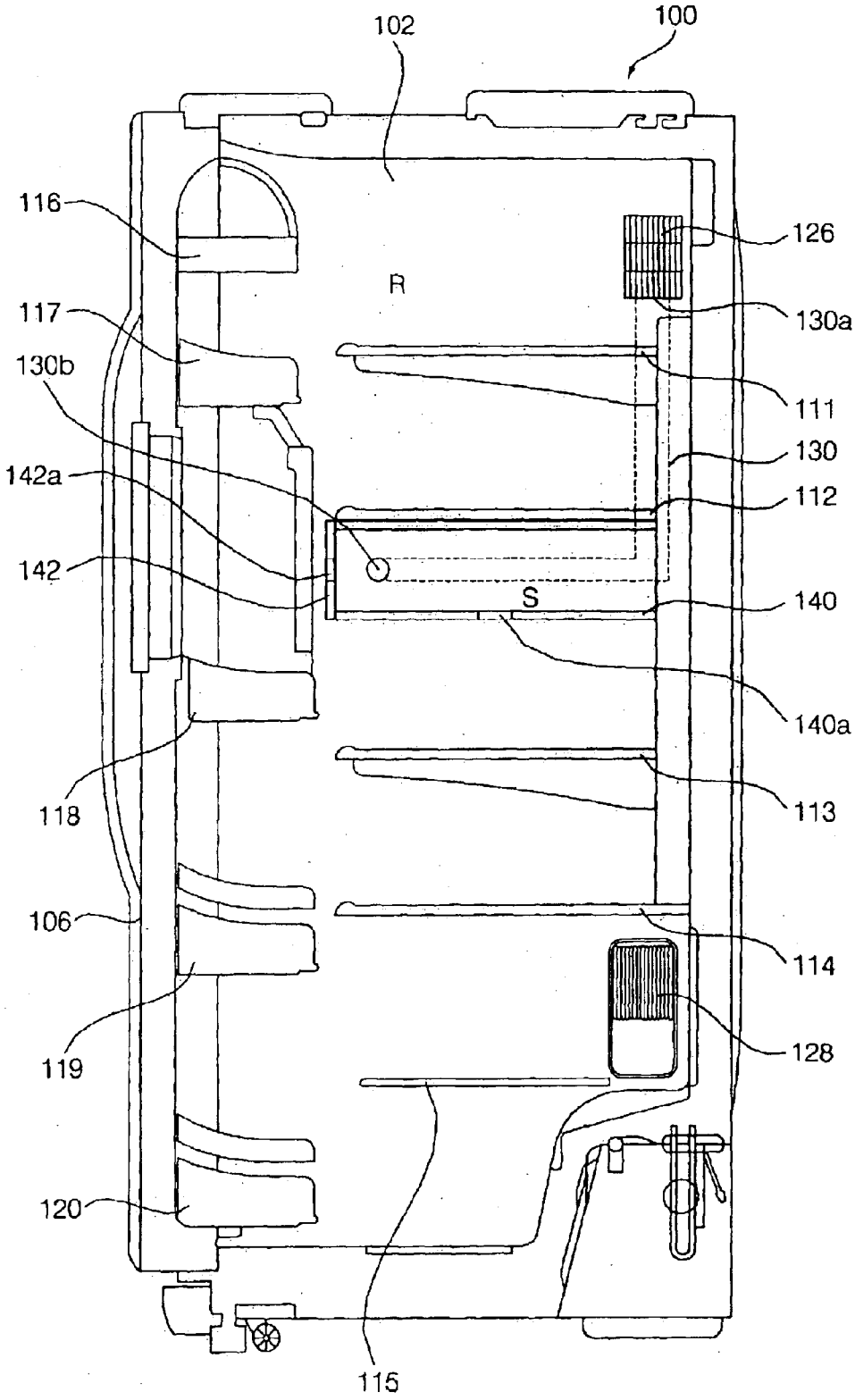
FIG. 8 is a side view showing a refrigerating chamber of the refrigerator according to the first preferred embodiment of the present invention.

FIG. 6 is a schematic front view showing the interior of the refrigerator according to the first preferred embodiment of the present invention, FIG. 7 is a side view showing a freezing chamber of the refrigerator according to the first preferred embodiment of the present invention, and FIG. 8 is a side view showing a refrigerating chamber of the refrigerator according to the first preferred embodiment of the present invention.

In a refrigerator 100 of the present invention are formed a freezing chamber F and a refrigerating chamber R, which is arranged next to the freezing chamber F, as shown in FIGS. 6 to 8. Between the freezing chamber F and the refrigerating chamber R is vertically disposed a barrier 102, by which the freezing chamber F and the refrigerating chamber R are separated from each other. To the front part of the freezing chamber F is pivotably attached a door 104. Similarly, another door 106 is pivotably attached to the front part of the refrigerating chamber R.

In the freezing chamber F are vertically arranged: a plurality of spaced shelves 111, 112, 113, 114, and 115, by which the interior of the freezing chamber F is partitioned into a plurality of storage spaces. On the shelves 111, 112, 113, 114, and 115 are put stored goods. Similarly, another plurality of spaced shelves 111, 112, 113, 114, and 115 are vertically arranged in the refrigerating chamber R. The interior of the refrigerating chamber R is partitioned into a plurality of storage spaces by the shelves 111, 112, 113, 114, and 115. On the shelves 111, 112, 113, 114, and 115 are also put stored goods.

To the rear part of the door 104 are vertically attached a plurality of baskets 116, 117, 118, 119, and 120, which are spaced apart from each other. Similarly, another plurality of baskets 116, 117, 118, 119, and 120 are vertically attached to the rear part of the door 106. The baskets 116, 117, 118, 119, and 120 attached to the rear part of the door 106 are also spaced apart from each other. The shelves 111, 112, 113, 114, and 115 of the freezing chamber F are vertically arranged while the front ends of the shelves 111, 112, 113, 114, and 115 are spaced apart from the rear part of the door 104 and the baskets 116, 117, 118, 119, ard 12C attached to the rear part of the door 104, respectively, so that a passage is defined between the shelves 111, 112, 113, 114, and 115 and the baskets 116, 117, 118, 119, and 120 or the rear part of the door 104. Similarly, the shelves 111, 112, 113, 114, and 115 of the refrigerating chamber R are vertically arranged while the front ends of the shelves 111, 112, 113, 114, and 115 are spaced apart from the rear part of the door 106 and the baskets 116, 117, 118, 119, and 120 attached to the rear part of the door 106, respectively, so that a passage is defined between the shelves 111, 112, 113, 114, and 115 and the baskets 116, 117, 118, 119, and 120 or the rear part of the door 106.

As shown in FIGS. 6 and 7, the evaporator 58 and the blowing fan 60 are disposed at the rear of the freezing chamber F. The freezing chamber F is provided at the upper rear part thereof with a cool air inlet hole 122, which is an entering channel of the freezing chamber F. The freezing chamber F is also provided at the lower rear part thereof with a cool air outlet hole 124, which is a leaving channel of the freezing chamber F Consequently, air cooled by the evaporator 58 is introduced into the freezing chamber F via the cool air inlet hole 122, and discharged from the freezing chamber F via the cool air outlet hole 124 so that the air is returned to the evaporator 58.

As shown in FIGS. 6 and 8, the barrier 102 is provided at the upper part thereof with a cool air inlet duct 126, which is an entering channel of the refrigerating chamber R, and the barrier 102 is also provided at the lower part thereof with a cool air outlet duct 128, which is a leaving channel of the refrigerating chamber R. Consequently, air cooled by the evaporator 58 is introduced into the refrigerating chamber R via the cool air inlet duct 126, and discharged from the refrigerating chamber R via the cool air outlet duct 128 so that the air is returned to the evaporator 58.

The rapid cooling chamber S is partitioned in such a manner that the rapid cooling chamber S does not directly communicate with the cool air inlet hole 122 for the freezing chamber F and the cool air inlet duct 126 for the refrigerating chamber R. Consequently, it is possible to individually cool the rapid cooling chamber S.

The rapid cooling chamber S may be mounted in at least one of the freezing chamber F and the refrigerating chamber R. When the rapid cooling chamber S is mounted in the refrigerating chamber R, it is possible to prevent the rapid cooling chamber S from being unnecessarily excessively cooled, and contribute to the convenience of a user. Accordingly, an example of installing the rapid cooling chamber S in the refrigerating chamber R will be hereinafter described in detail.

The rapid cooling chamber S comprises: a rapid cooling panel 140 attached to the refrigerating chamber R, the rapid cooling panel 140 having a stored goods receiving space defined therein and a stored goods entrance formed at the front part thereof; and a lid 142 pivotably attached to the rapid cooling panel 140 at the front part thereof for closing the stored good entrance of the rapid cooling panel 140.

At the rapid cooling panel 140 ard the lid 142 are preferably formed cool air guide holes 140*a* and 142*a*, respectively, through which the cool air having rapidly cooled the interior of the rapid cooling chamber S is guided into the refrigerating chamber R.

The side of the rapid cooling panel 140, which is opposite to the second load sensing sensor 66, is open so that the second load sensing sensor 66 senses a load in the rapid cooling chamber S. Alternatively, the side of the rapid cooling panel 140, which is opposite to the second load sensing sensor 66, may have a sensing hole formed therethrough so that the second load sensing sensor 66 senses a load in the rapid cooling chamber S.

The rapid cooling channel, which is made up of a rapid cooling duct 130, is formed in the barrier 102. The rapid cooling duct 130 has one end 130*a* communicating with the cool air inlet duct 126, and the other end 130*b* communicating with the rapid cooling chamber S.

As shown in FIG. 6, the damper 62 is disposed in the cool air inlet duct 126 communicating with the rapid cooling duct 130 for controlling the flow of the cool air through the cool air inlet duct 126 and the rapid cooling duct 130.

When the damper 62 is positioned perpendicular to the direction of the flow of the cool air along the cool air inlet duct 126 ("A" position, damper off mode), the cool air is not introduced into the refrigerating chamber R or the rapid cooling chamber S. When the damper 62 is positioned parallel with the direction of the flow of the cool air along the cool air inlet duct 126 ("B" position, refrigerating chamber mode), the cool air is mainly introduced into the refrigerating chamber R. When the damper 62 is positioned at an angle to the direction of the flow of the cool air along the cool air inlet duct 126 ("C" position, rapid cooling chamber mode), the cool air is mainly introduced into the rapid cooling chamber S.

The first load sensing sensor 64 is a temperature sensor for sensing the temperature in the freezing chamber F or the refrigerating chamber R.

The second load sensing sensor 66 is an infrared sensor disposed facing the interior of the rapid cooling chamber S. The second load sensing sensor 66 comprises a temperature sensing unit for applying an infrared ray to the interior of the rapid cooling chamber S to sense the surface temperature of a load in the rapid cooling chamber S, and a thermistor for sensing the temperature around the load in the rapid cooling chamber S. The real temperature of the load is obtained from the difference between the value of the temperature sensed by the temperature sensing unit and the value of the temperature sensed by the thermistor.

The second load sensing sensor 66 may be mounted to a side of the barrier 102, or to any one of the rear part of the refrigerating chamber R and the shelf 112 of the refrigerating chamber R. Preferably, the second load sensing sensor 66 is preferably disposed near the corner of the rapid cooling chamber. S to sense the entire interior of the rapid cooling chamber S.

Figure 9:
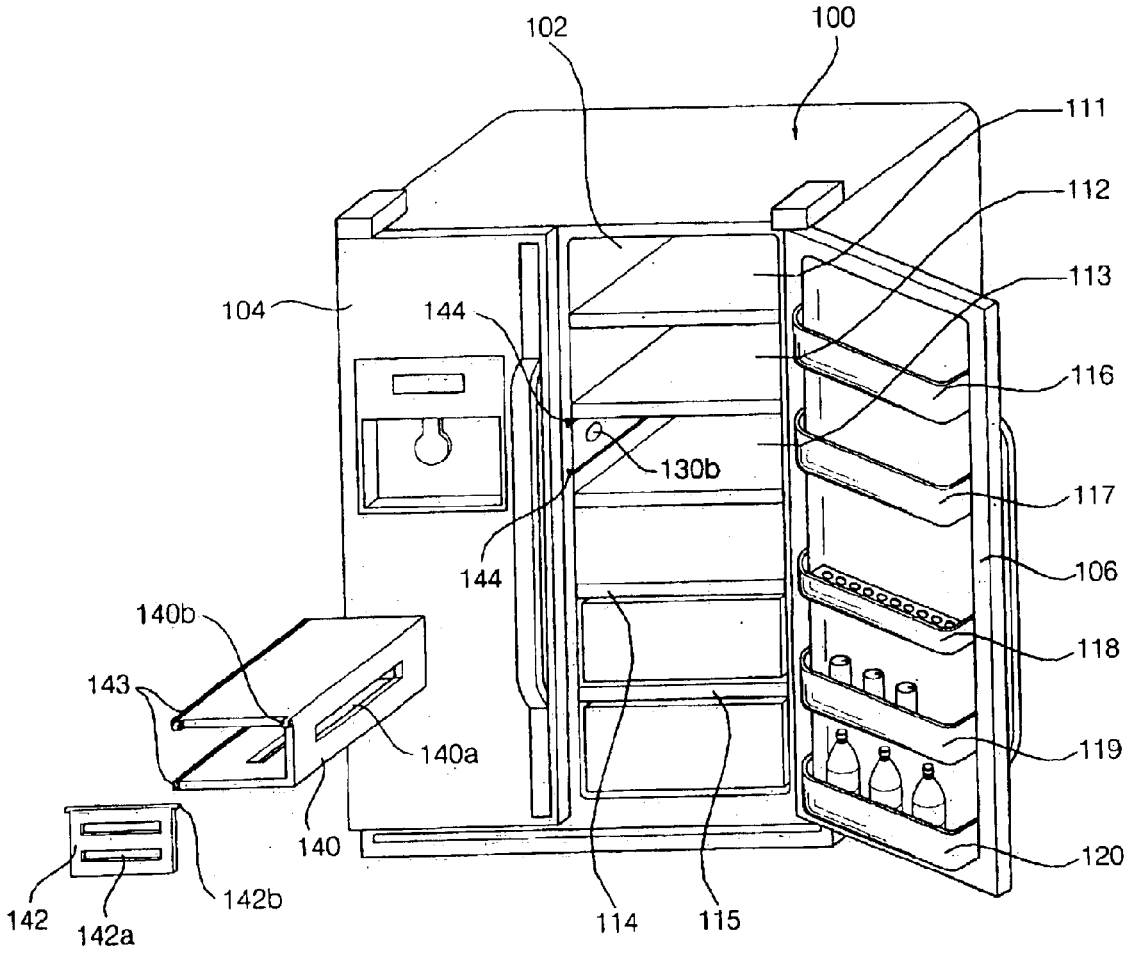
FIG. 9 is an exploded perspective view showing an example of a rapid cooling panel according to the present invention.

FIG. 9 is an exploded perspective view showing an example of the rapid cooling panel according to the present invention.

As shown in FIG. 9, the rapid cooling panel 140 has an open side, which is opposite to the end 130*b* of the rapid cooling duct 130. The cool air supplied through the rapid cooling duct 130 is introduced into the rapid cooling panel 140 via the open side of the rapid cooling panel 140.

The rapid cooling panel 140 is provided with hinge grooves 140*b*, and the lid 142 is provided with hinge bars 142*b*. The lid 142 is pivotably attached to the rapid cooling panel 140 by the combination of the hinge grooves 140*b* and the hinge bars 142*b*.

The refrigerator may further comprise guides 143 and 144 for facilitating the attachment of the rapid cooling panel 140 to the refrigerating chamber R.

Specifically, the guide 143 may be made up of a pair of guide protrusions, which are spaced evenly apart from each other and longitudinally extended. The guide protrusions 143 are formed at the rapid cooling panel 140. Similarly, the guide 144 may be made up of a pair of guide grooves, which are spaced evenly apart from each other and longitudinally extended. The guide grooves 144 are formed at any one of the barrier 102, the shelf 112 of the refrigerating chamber R, and the rear part of the refrigerating chamber R. The rapid cooling panel 140 is attached to the refrigerating chamber R by the engagement of the guide protrusions 143 with the guide grooves 144 in a sliding or drawing fashion.

Alternatively, the guide 143 may be made up of a hook (not shown), which is formed at the rapid cooling panel 140, and the guide 144 may be made up of a hook hole (not shown), which is formed at any one of the barrier 102, the shelf 112 of the refrigerating chamber R, and the rear part of the refrigerating chamber R. The rapid cooling panel 140 is attached to the refrigerating chamber R by the engagement of the hook 143 with the hook hole 144 in a hooking fashion.

Figure 10:
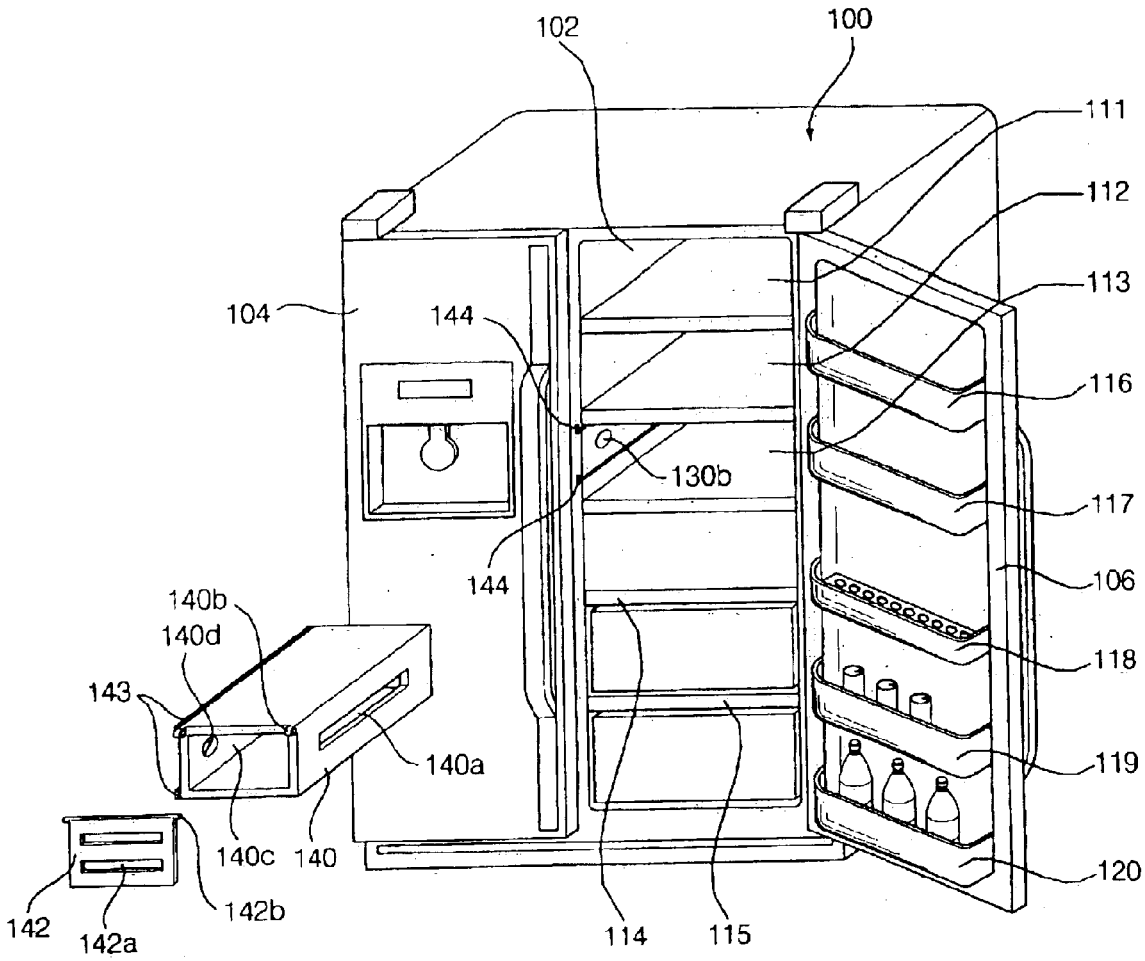
FIG. 10 is an exploded perspective view showing another example of the rapid cooling panel according to the present invention.

FIG. 10 is an exploded perspective view showing another example of the rapid cooling panel according to the present invention.

As shown in FIG. 10, the rapid cooling panel 140 has a side 140*c*, which is opposite to the end 130*b* of the rapid cooling duct 130. The side 140*c* of the rapid cooling panel 140 has an introducing hole 140*d* formed therethrough. The introducing hole 140*d* communicates with the end 130*b* of the rapid cooling duct 130.

The attachment of the rapid cooling panel 140 to the refrigerating chamber R and the structure of lid 142 are identical to those of the previous example of the rapid cooling panel 140, which will not be hereinafter described.

The operation of the refrigerator with the above-stated construction according to the first preferred embodiment of the present invention will now be described.

Figure 11:
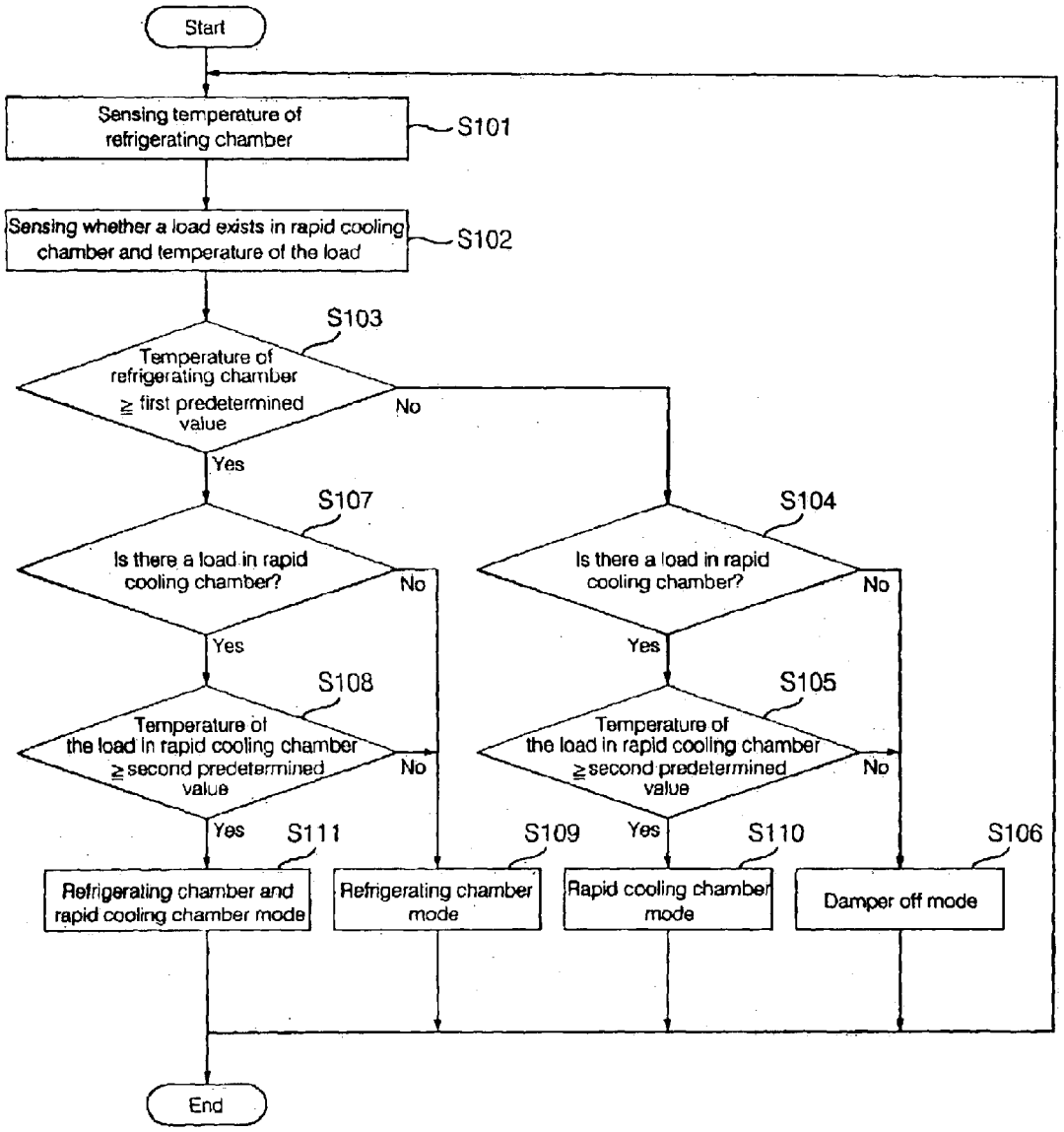
FIG. 11 is a flow chart illustrating a method of controlling the refrigerator according to the first preferred embodiment of the present invention.

FIG. 11 is a flow chart illustrating a method of controlling the refrigerator according to the first preferred embodiment of the present invention.

The first load sensing sensor 64 senses the temperature of the freezing chamber F or the refrigerating chamber R (S101).

The second load sensing sensor 66 senses whether a load exists in the rapid cooling chamber S or not, and then senses the temperature of the load when the load exists in the rapid cooling chamber S (S102).

The controller 68 shifts the damper 62 to the "A" position (damper off mode) so that the cool air is not introduced into the refrigerating chamber R or the rapid cooling chamber S, when the temperature of the freezing chamber F or the refrigerating chamber R sensed by the first load sensing sensor 64 is below a first predetermined value, and when the second load sensing sensor 66 senses no load or the temperature of the load sensed by the second load sensing sensor 66 is below a second predetermined value (S103, S104, S105, S106).

The controller 69 stops the operations of the compressor 52 and the blowing fan 60.

As time goes by or if the door 106 of the refrigerating chamber R is repeatedly opened, the temperature of the refrigerating chamber R rises.

The controller 68 shifts the damper 62 to the "B" position (refrigerating chamber mode) so that the cool air is introduced into the refrigerating chamber R, when the temperature of the freezing chamber F or the refrigerating chamber R sensed by the first load sensing sensor 64 is not less than the first predetermined value, and when the second load sensing sensor 66 senses no load or the temperature of the load sensed by the second load sensing sensor 66 is below the second predetermined value (S103, S107, S108, S109).

The controller 69 operates the compressor 52 and the blowing fan 60.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the blowing fan 60 so that the freezing chamber F is maintained at a low temperature, and then returned to the vicinity of the evaporator 58. The remainder of the cool air surrounding the evaporator 58 is supplied to the refrigerating chamber R via the cool air inlet duct 126 and the damper 62.

The cool air supplied to the refrigerating chamber R is downwardly moved along the refrigerating chamber R to maintain the interior of the refrigerating chamber R at a low temperature below the first predetermined value, and then returned to the vicinity of the evaporator 58 via the cool air outlet duct 128.

When stored goods to be rapidly cooled are put in the rapid cooling chamber S of the refrigerator, a new load exists in the rapid cooling chamber S.

The controller 68 shifts the damper 62 to the "C" position (rapid cooling chamber mode) so that the cool air is introduced into the rapid cooling chamber S, when the temperature of the freezing chamber F or the refrigerating chamber R sensed by the first load sensing sensor 64 is below the first predetermined value, and when the second load sensing sensor 66 senses a load in the rapid cooling chamber S and the temperature of the load in the rapid cooling chamber S sensed by the second load sensing sensor 66 is not less than the second predetermined value (S103, S104, S105, S110).

The controller 69 operates the compressor 52 and the blowing fan 60.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the blowing fan 60 so that the freezing chamber F is maintained at a low temperature, and then returned to the vicinity of the evaporator 58. The remainder of the cool air surrounding the evaporator 58 is supplied to the rapid cooling chamber S via the cool air inlet duct 126, the damper 62, and the rapid cooling duct 130.

The cool air supplied to the rapid cooling chamber S rapidly cools the interior of the rapid cooling chamber S, and is then guided into the refrigerating chamber R via the cool air guide holes 140*a* and 142*a* formed at the rapid cooling panel 140 and the lid 142, respectively. The cool air guided into the refrigerating chamber R is downwardly moved along the refrigerating chamber R, and then returned to the vicinity of the evaporator 58 via the cool air outlet duct 128.

Stored goods to be rapidly cooled may be put in the rapid cooling chamber S while the temperature of the refrigerating chamber R is high. The controller 68 shifts the damper 62 to the "B" position (refrigerating chamber mode) so that the cool air is introduced into the refrigerating chamber R for a first predetermined time (for example, three minutes) and then shifts the damper 62 to the "C" position (rapid cooling chamber mode) so that the cool air is introduced into the rapid cooling chamber S for a second predetermined time (for example, one minute), when the temperature of the refrigerating chamber R sensed by the first load sensing sensor 64 is not less than the first predetermined value, and when the second load sensing sensor 66 senses a load in the rapid cooling chamber S and the temperature of the load in the rapid cooling chamber S sensed by the second load sensing sensor 66 is not less than the second predetermined value (S103, S107, S108, S111). The refrigerating chamber mode and the rapid cooling chamber mode may be repeatedly switched.

The controller 69 operates the compressor 52 and the blowing fan 6Q.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the blowing fan 60 so that the freezing chamber F is maintained at a low temperature, and then returned to the vicinity of the evaporator 58. The remainder of the cool air surrounding the evaporator 58 is supplied to the refrigerating chamber R via the cool air inlet duct 126 for the first predetermined time, and then it is supplied to the rapid cooling chamber S via the cool air inlet duct 126 for the second predetermined time.

The cool air supplied to the refrigerating chamber R is downwardly moved along the refrigerating chamber R to maintain the interior of the refrigerating chamber R at a low temperature, and then returned to the vicinity of the evaporator 58 via the cool air outlet duct 128. The cool air supplied to the rapid cooling chamber S rapidly cools the interior of the rapid cooling chamber S, and is then guided into the refrigerating chamber R via the cool air guide holes 140*a* and 142*a* formed at the rapid cooling panel 140 and the lid 142, respectively. The cool air guided into the refrigerating chamber R is downwardly moved along the refrigerating chamber R, and then returned to the vicinity of the evaporator 58 via the cool air outlet duct 128.

Figure 12:
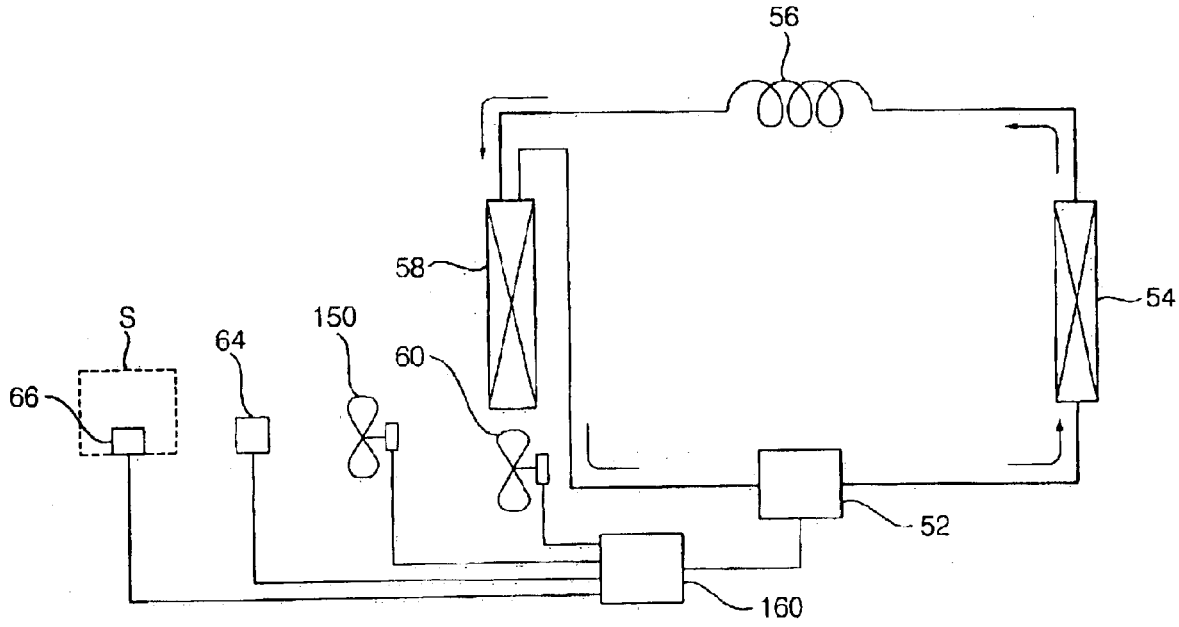
FIG. 12 is a block diagram of a refrigerator according to a second preferred embodiment of the present invention showing a refrigerating cycle constituted by main components of the refrigerator.

FIG. 12 is a block diagram of a refrigerator according to a second preferred embodiment of the present invention showing a refrigerating cycle constituted by main components of the refrigerator.

As shown in FIG. 12, the refrigerator according to the second preferred embodiment of the present invention comprises: a compressor 52 for compressing low-temperature and low-pressure gaseous coolant to obtain high-temperature and high-pressure gaseous coolant; a condenser 54 for condensing the high-temperature and high-pressure gaseous coolant compressed by the compressor 52 so that heat from the high-temperature and high-pressure gaseous coolant passing through the condenser 54 is emitted to air surrounding the condenser 54; an expander 56 for decompressing the liquid-phased coolant condensed by the condenser 54; an evaporator 58 for evaporating the coolant expanded by the expander 56 so that the expanded coolant passing through the evaporator 58 absorbs heat from air surrounding the evaporator 58; a first blowing fan 60 for blowing the air cooled by the evaporator 5B to a freezing chamber F of the refrigerator or a refrigerating chamber R of the refrigerator and blowing the cool air in the freezing chamber or the refrigerating chamber to the vicinity of the evaporator 58 so that the cool air is circulated in the refrigerator; a rapid cooling chamber S mounted in the refrigerating chamber R; a second blowing fan 150 for blowing the cool air in the freezing chamber F to the rapid cooling chamber S; a first load sensing sensor 64 for sensing a load in the freezing chamber F or the refrigerating chamber R; a second load sensing sensor 66 for sensing a load in the rapid cooling chamber S; and a controller 160 for controlling the compressor 52, the first blowing fan 60, and the second blowing fan 150 on the basis of signals outputted from the first load sensing sensor 64 and the second load sensing sensor 66.

Figure 13:
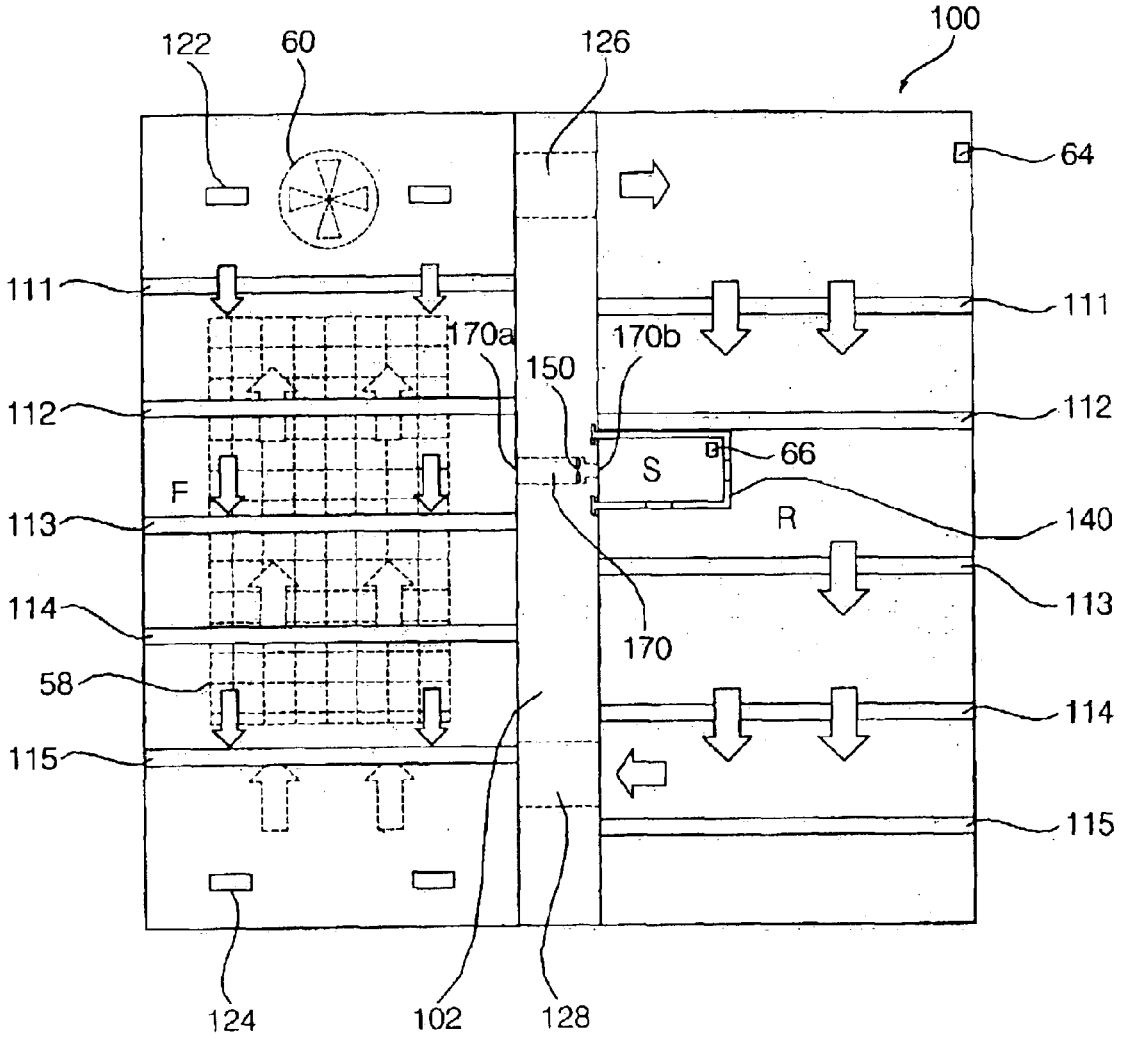
FIG. 13 is a schematic front view showing the interior of the refrigerator according to the second preferred embodiment of the present invention.

FIG. 13 is a schematic front view showing the interior of a refrigerator 100 according to the second preferred embodiment of the present invention.

As shown in FIG. 13, between the freezing chamber F and the refrigerating chamber R is vertically disposed a barrier 102, by which time freezing chamber F and the refrigerating chamber R are separated from each other in the refrigerator 100.

In the barrier is formed a rapid cooling channel, along which the cool air supplied to the freezing chamber F is introduced into the rapid cooling chamber S.

The rapid cooling channel is made up of a rapid cooling duct 170. The rapid cooling duct 170 has one end 170*a* communicating with the freezing chamber F, and the other end 170*b* communicating with the rapid cooling chamber S.

Preferably, the end 170*a* of the rapid cooling duct 170 communicates with the freezing chamber F while it is spaced a described distance from a cool air inlet hole 122, through which cool air is supplied to the freezing chamber F. The cool air inlet hole 122 is an entering channel of freezing chamber F.

The second blowing fan 150 is preferably mounted in the rapid cooling duct 170.

This embodiment of the present invention is identical in its construction and operation to the first preferred embodiment of the present invention except that the refrigerator according to this embodiment of the present invention has the second blowing fan 150 and the rapid cooling duct 170 instead of the damper 62 and the rapid cooling duct 130 as in the first preferred embodiment of the present invention, and the rapid cooling chamber S is mounted only in the refrigerating chamber R. Accordingly, no further detailed description of other components of the refrigerator according to this embodiment of the present invention will be provided.

The operation of the refrigerator with the above-stated construction according to the second preferred embodiment of the present invention will now be described.

Figure 14:
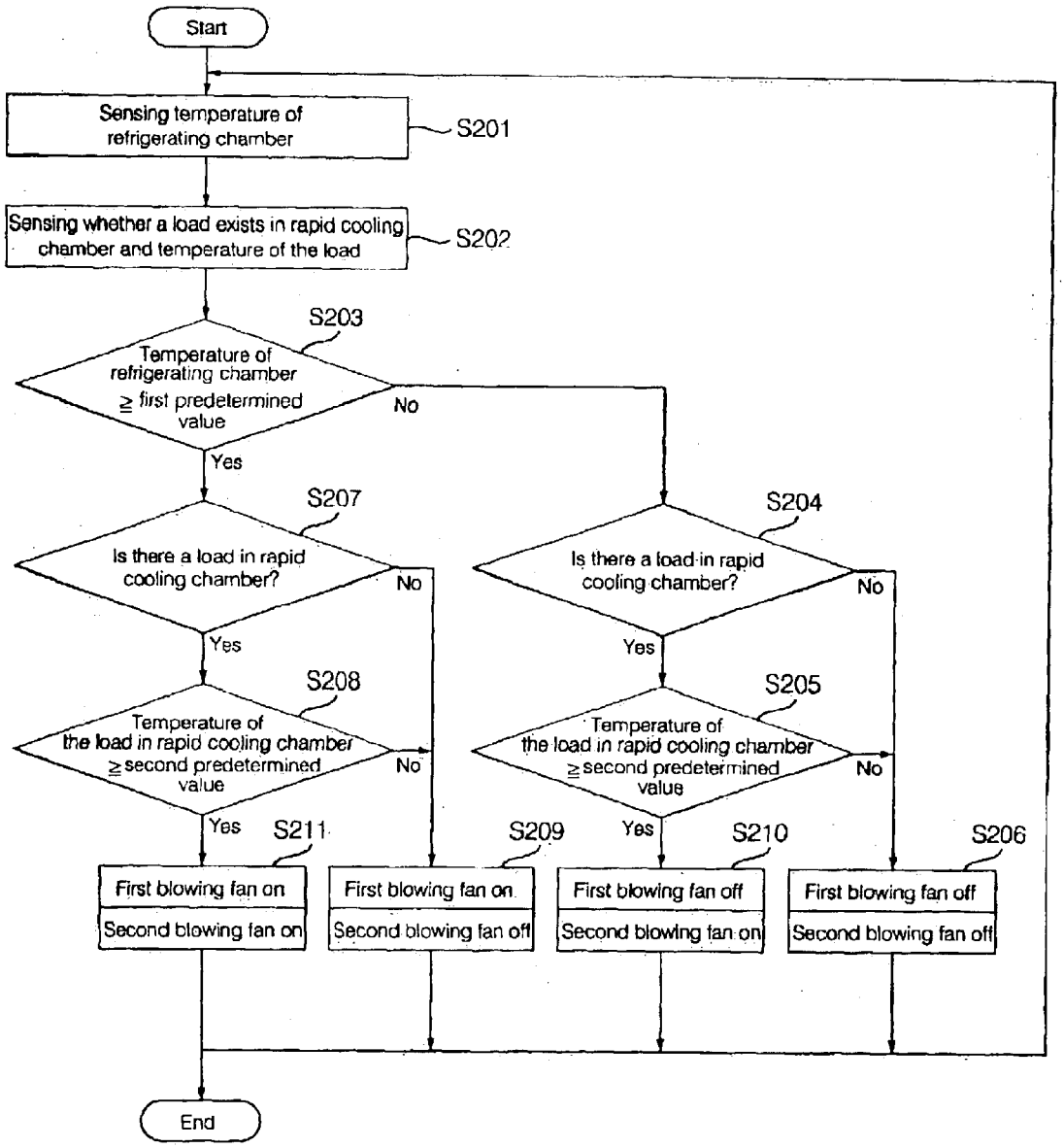
FIG. 14 is a flow chart illustrating a method of controlling the refrigerator according to the second preferred embodiment of the present invention.

FIG. 14 is a flow chart illustrating a method of controlling the refrigerator according to the second preferred embodiment of the present invention.

The first load sensing sensor 64 senses the temperature of the freezing chamber F or the refrigerating chamber R (S201).

The second load sensing sensor 66 senses whether a load exists in the rapid cooling chamber S or not, and then senses the temperature of the load when the load exists in the rapid cooling chamber S (S202).

The controller 16Q stops the operations of the first blowing fan 60 and the second blowing fan 150 (first and second blowing fans off) so that the cool air is not introduced into the freezing chamber F, the refrigerating chamber R, or the rapid cooling chamber S, when the temperature of the freezing chamber F or the refrigerating chamber R sensed by the first load sensing sensor 64 is below a first predetermined value, and when the second load sensing sensor 66 senses no load or the temperature of the load sensed by the second load sensing sensor 66 is below a second predetermined value (S203, S204, S205, S206).

The controller 160 stops the operation of the compressor 52.

As time goes by or if the door 106 of the refrigerating chamber R is repeatedly opened, the temperature of the refrigerating chamber R rises.

The controller 160 operates the first blowing fan 60 and stops the operation of the second blowing fan 150 (first blowing fan on and second blowing fan off), when the temperature of the freezing chamber F or the refrigerating chamber R sensed by the first load sensing sensor 64 is not less than the first predetermined value, and when the second load sensing sensor 66 senses no load or the temperature of the load sensed by the second load sensing sensor 66 is below the second predetermined value (S203, S207, S208, S209).

The controller 16C operates the compressor 52.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the first blowing fan 60 so that the freezing chamber F is maintained at a low temperature, and then returned to the vicinity of the evaporator 58. The remainder of the cool air surrounding the evaporator 58 is supplied to the refrigerating chamber R via the cool air inlet duct 126.

The cool air supplied to the refrigerating chamber R is downwardly moved along the refrigerating chamber R to maintain the interior of the refrigerating chamber R at a low temperature, and then returned to the vicinity of the evaporator 58 via the cool air outlet duct 128.

When stored goods to be rapidly cooled are put in the rapid cooling chamber S of the refrigerator, a new load exists in the rapid cooling chamber S.

The controller 160 stops the operation of the first blowing fan 60 and operates the second blowing fan 150 (first blowing fan off and second blowing fan on), when the temperature of the freezing chamber F or the refrigerating chamber R sensed by the first load sensing sensor 64 is below the first predetermined value, ard when the second load sensing sensor 66 senses a load in the rapid cooling chamber S and the temperature of the load in the rapid cooling chamber S sensed by the second load sensing sensor 66 is not less than the second predetermined value (S203, S204, S205, S210).

The controller 69 stops the operation of the compressor 52.

At this time, the cool air in the freezing chamber F is supplied to the rapid cooling chamber S via the rapid cooling duct 170 by the second blowing fan 150.

The cool air supplied to the rapid cooling chamber S rapidly cools the interior of the rapid cooling chamber S, and is then guided into the refrigerating chamber R via the cool air guide holes 140*a* and 142*a* formed at the rapid cooling panel 140 and the lid 142, respectively. The cool air guided into the refrigerating chamber R is returned to the vicinity of the evaporator 58 via the cool air outlet duct 128.

Stored goods to be rapidly cooled may be put in the rapid cooling chamber S while the temperature of the refrigerating chamber R is high. The controller 160 operates the first blowing fan 60 and the second blowing fan 150 (first and second blowing fans on), when the temperature of the freezing chamber F or the refrigerating chamber R sensed by the first load sensing sensor 64 is not less than the first predetermined value, and when the second load sensing sensor 66 senses a load in the rapid cooling chamber S and the temperature of the load in the rapid cooling chamber S sensed by the second load sensing sensor 66 is not less than the second predetermined value (S203, S207, S208, S211).

The controller 160 operates the compressor 52.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the first blowing fan 60 so that the freezing chamber F is maintained at a low temperature, and then returned to the vicinity of the evaporator 58. The remainder of the cool air surrounding the evaporator 58 is supplied to the refrigerating chamber R via the cool air inlet duct 126 so that the refrigerating chamber R is maintained at a low temperature, and then returned to the vicinity of the evaporator 58.

Some of the cool air in the freezing chamber F is supplied to the rapid cooling chamber S by the second blowing fan 150. The cool air supplied to the rapid cooling chamber S rapidly cools the interior of the rapid cooling chamber S, and is then guided into the refrigerating chamber R via the cool air guide holes 140*a* and 142*a* formed at the rapid cooling panel 140 and the lid 142, respectively. The cool air guided into the refrigerating chamber R is downwardly moved along the refrigerating chamber R, and then returned to the vicinity: of the evaporator 58 via the cool air outlet duct 128.

Figure 15:
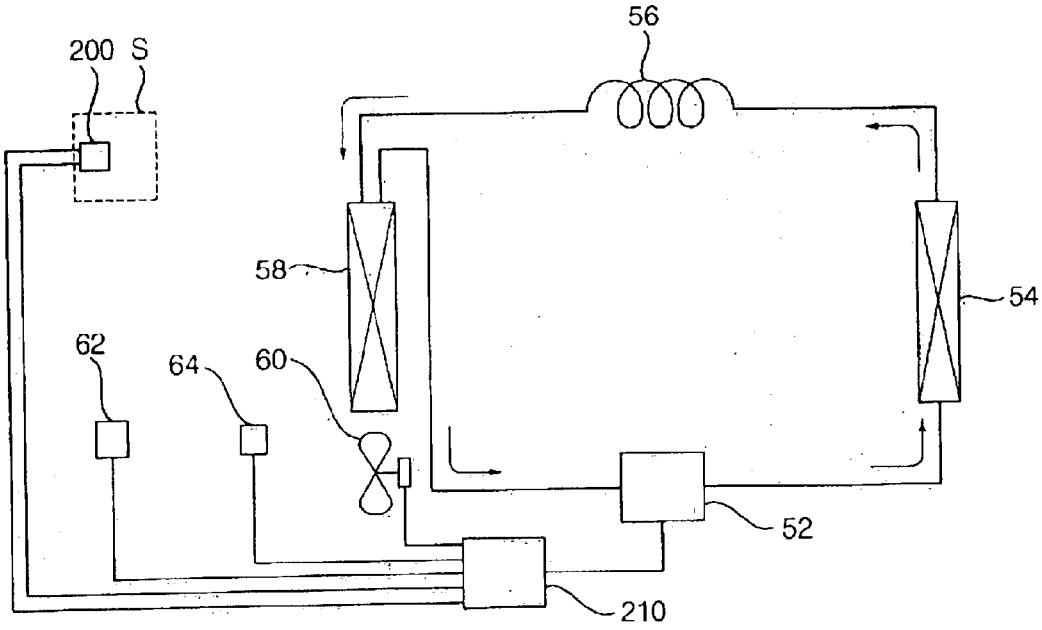
FIG. 15 is a block diagram of a refrigerator according to a th-rd preferred embodiment of the present invention showing a refrigerating cycle constituted by main components of the refrigerator.

FIG. 15 is a block diagram of a refrigerator according to a third preferred embodiment of the present invention showing a refrigerating cycle constituted by main components of the refrigerator.

As shown in FIG. 15, the refrigerator according to the third preferred embodiment of the present invention comprises: a compressor 52 for compressing low-temperature and low-pressure gaseous coolant to obtain high-temperature and high-pressure gaseous coolant; a condenser 54 for condensing the high-temperature and high-pressure gaseous coolant compressed by the compressor 52 so that heat from the high-temperature and high-pressure gaseous coolant passing through the condenser 54 is emitted to air surrounding the condenser 54; an expander 56 for decompressing the liquid-phased coolant condensed by the condenser 54; an evaporator 58 for evaporating the coolant expanded by the expander 56 so that the expanded coolant passing through the evaporator 58 absorbs heat from air surrounding the evaporator 58; a blowing fan 60 for blowing the air cooled by the evaporator 58 to a freezing chamber of the refrigerator or a refrigerating chamber of the refrigerator and blowing the cool air in the freezing chamber or the refrigerating chamber to the vicinity of the evaporator 58 so that the cool air is circulated in the refrigerator.

In at least one of the freezing and refrigerating chambers of the refrigerator is mounted a rapid cooling chamber S for rapidly cooling stored goods. Also provided is a rapid cooling channel, along which cool air is introduced into the rapid cooling chamber S so that the stored goods in the rapid cooling chamber S are rapidly cooled regardless of a load in the freezing chamber or the refrigerating chamber.

In the refrigerator is also mounted a damper 62 for controlling the rate of supply of the cool air blown by the blowing fan 60 to the refrigerating chamber or the rapid cooling chamber S.

The refrigerator further comprises: a load sensing sensor 64 for sensing a load in the freezing chamber or the refrigerating chamber; a load-based cooling module 200 for sensing a load in the rapid cooling chamber S and supplying the cool air guided along the rapid cooling channel to the sensed load; and a controller 210 for controlling the compressor 52, the blowing fan 60, the damper 62, and the load-based cooling module 200 on the basis of signals outputted from the load sensing sensor 64 and the load-based cooling module 200.

Figure 16:
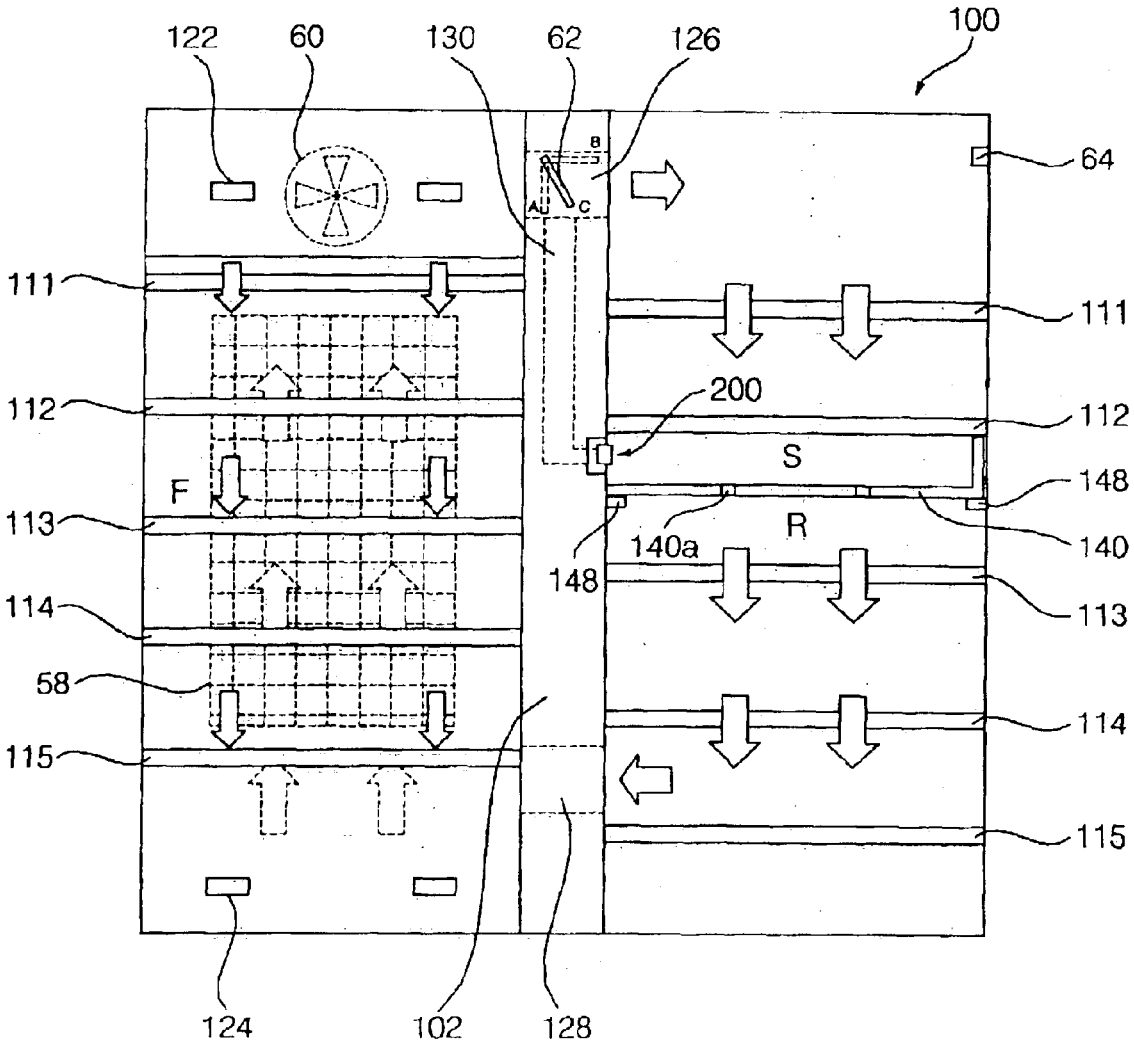
FIG. 16 is a schematic front view showing the interior of the refrigerator according to the third preferred embodiment of the present invention.
Figure 17:
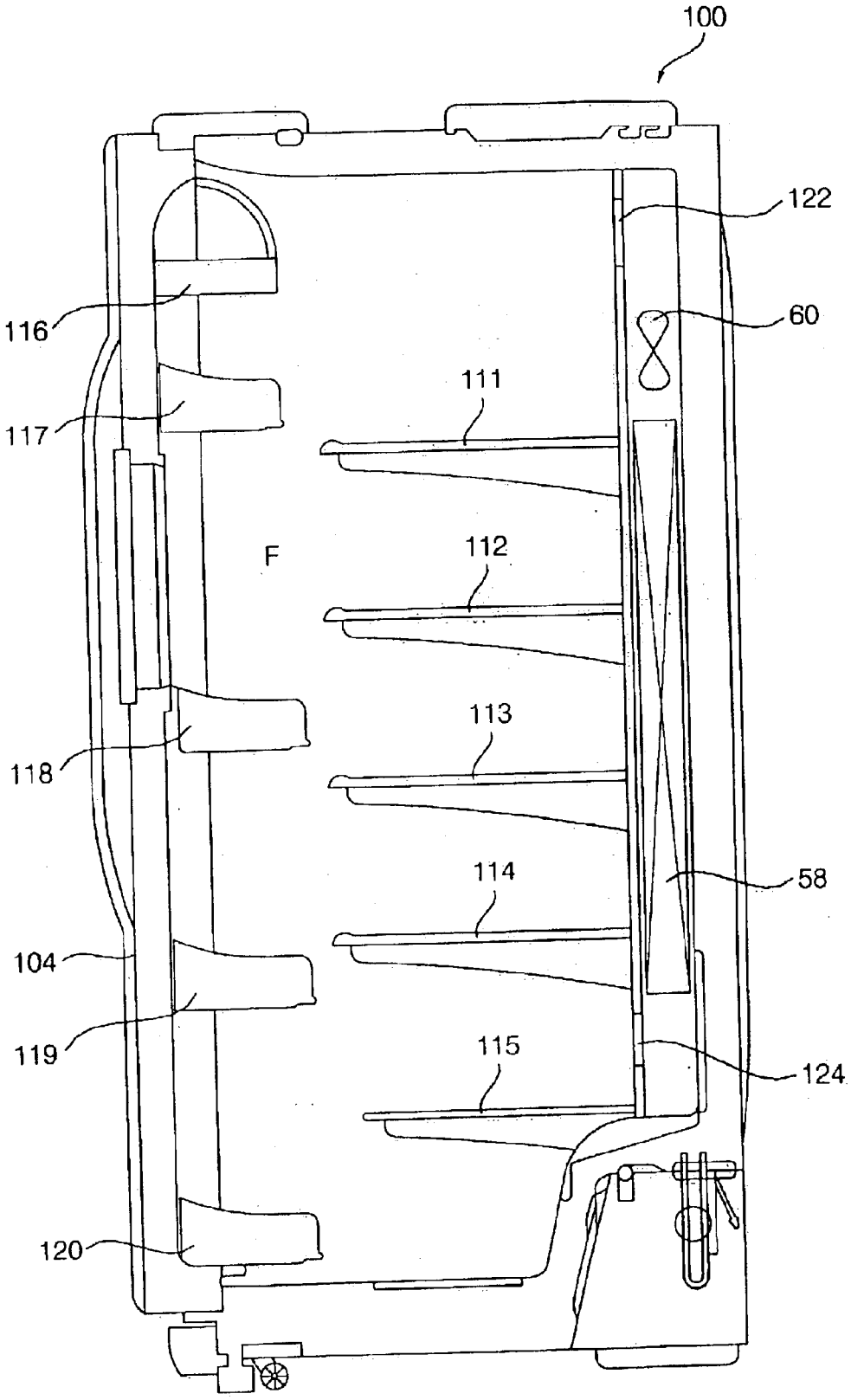
FIG. 17 is a side view showing a freezing chamber of the refrigerator according to the third preferred embodiment of the present invention.
Figure 18:
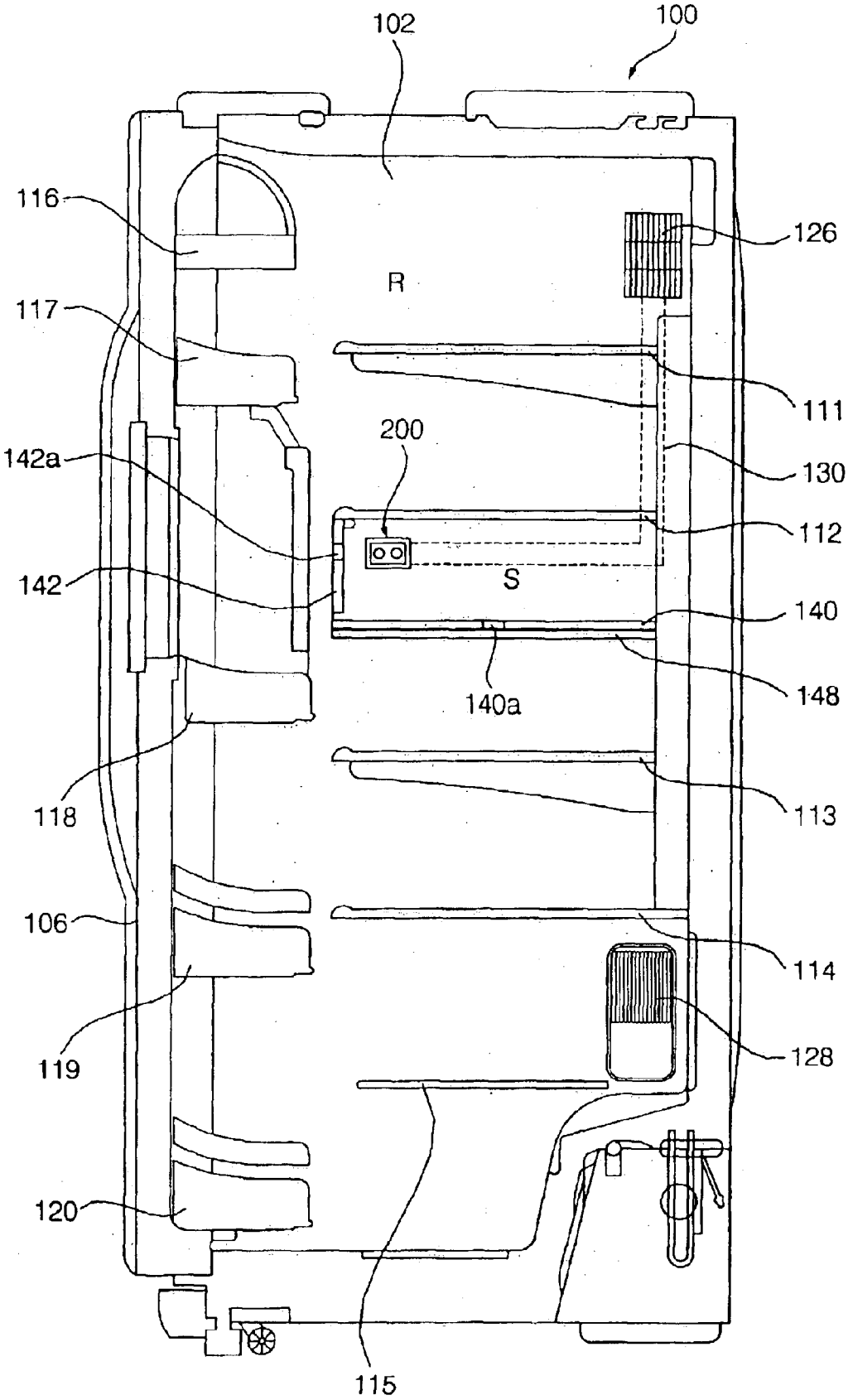
FIG. 18 is a side view showing a refrigerating chamber of the refrigerator according to the first preferred embodiment of the present invention.

FIG. 16 is a schematic front view showing the interior of the refrigerator according to the third preferred embodiment of the present invention, FIG. 17 is a side view showing a freezing chamber of the refrigerator according to the third preferred embodiment of the present invention, and FIG. 18 is a side view showing a refrigerating chamber of the refrigerator according to the first preferred embodiment of the present invention.

As can be seen from FIGS. 16 to 18, this embodiment of the present invention is identical in its construction and operation to the first preferred embodiment of the present invention except that the load-based cooling module 200 of this embodiment not only serves as the second load sensing sensor 66 as in the first embodiment of the present invention but also serves to guide the cool air supplied to the rapid cooling chamber S toward the load in the rapid cooling chamber S. Accordingly, no further detailed description of other components of the refrigerator according to this embodiment of the present invention will be provided.

Reference numeral 148 of FIGS. 16 and 18 indicates a pair of guide members, each of which is attached to the inner wall of the refrigerating chamber R below the shelf 112 of the refrigerating chamber R. One of the guide members 148 may be attached to the barrier 102. The rapid cooling panel 140, which constitutes the rapid cooling chamber S, is easily mounted in the refrigerating chamber R by means of the guide members 148 in a sliding fashion.

The load-based cooling module 200 intensively supplies the cool air to the rapid cooling chamber S so that a new high-temperature load in the rapid cooling chamber S is cooled only when the load exists in the rapid cooling chamber S. In other words, the load-based cooling module 200 does not supply the cool air to the rapid cooling chamber S when no load exists in the rapid cooling chamber S. The load-based cooling module 200 is attached to the barrier 102 while facing the rapid cooling chamber S so that the module 200 senses the load in the rapid cooling chamber S, and the intensive supply of the cool air is facilitated.

Figure 19:
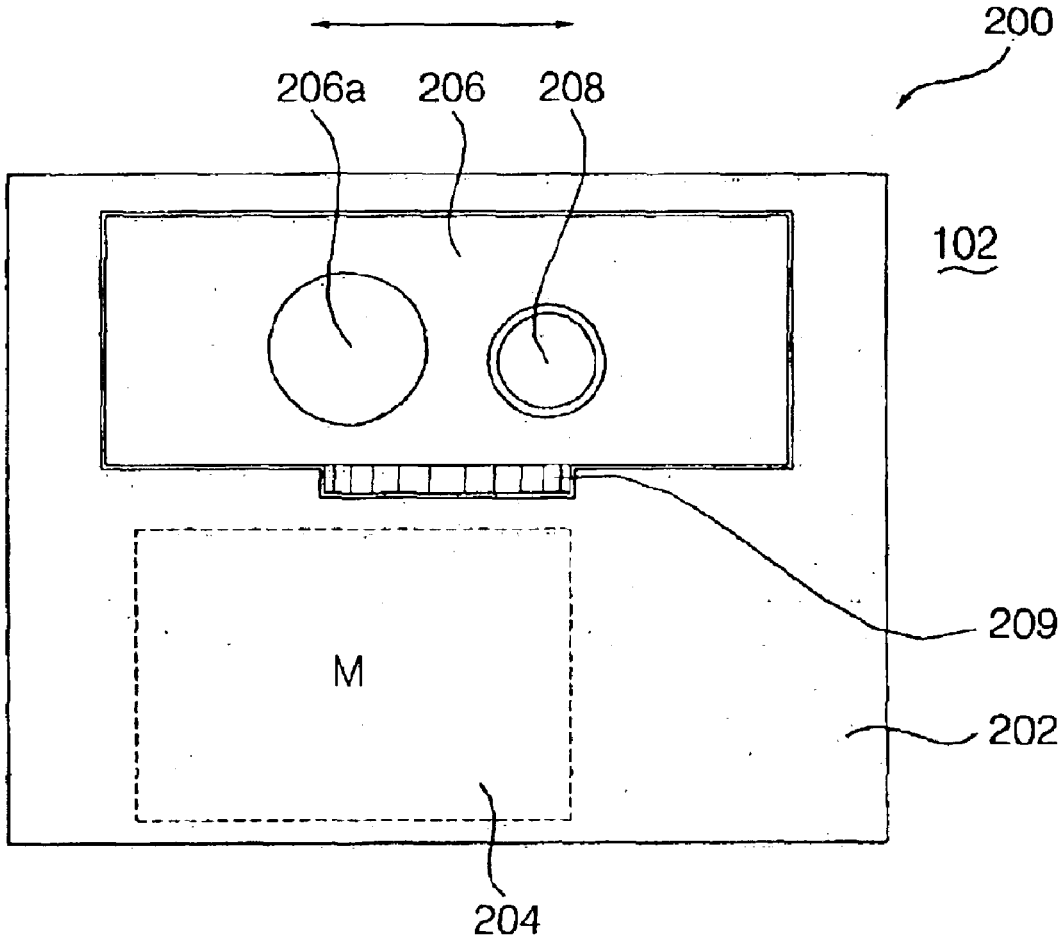
FIG. 19 is a side view showing a load-based cooling module according to the present invention in operation.
Figure 20:
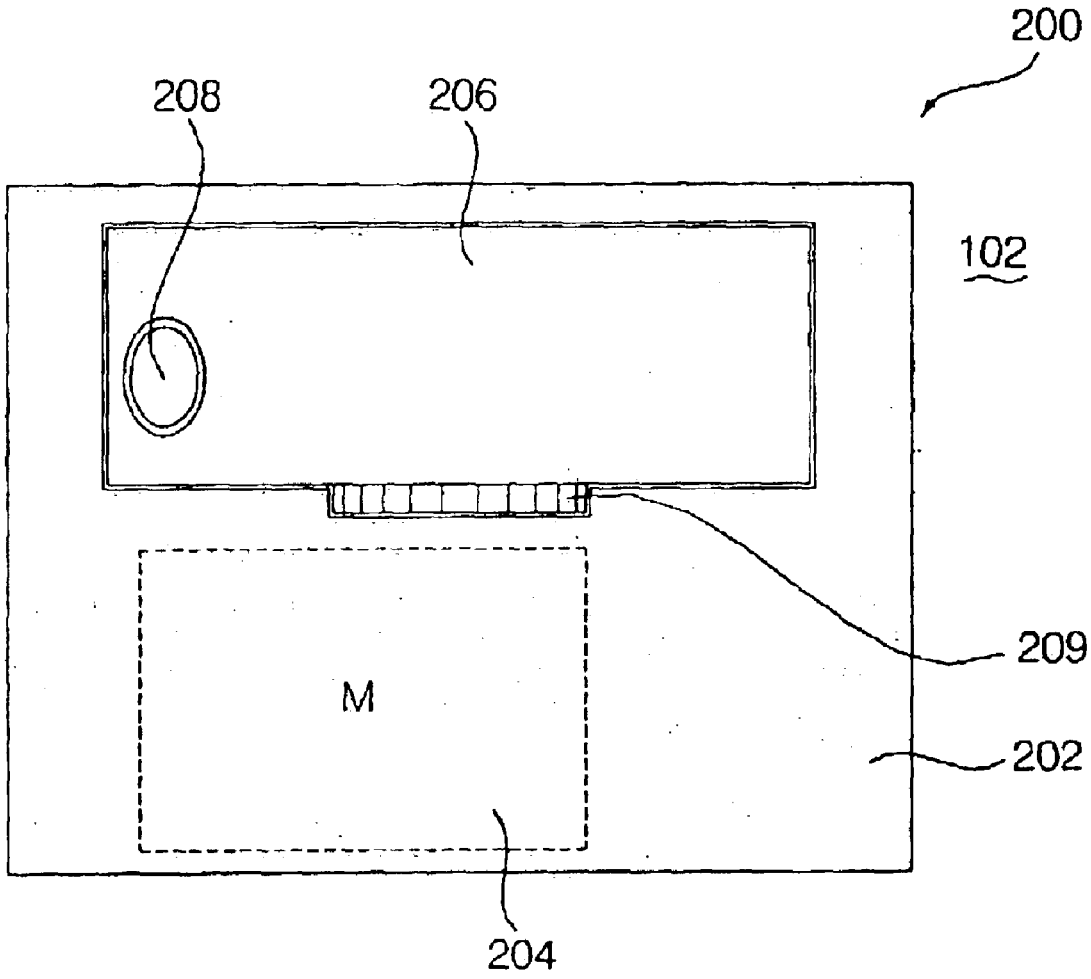
FIG. 20 is a side view showing the load-based cooling module according to the present invention not in operation.

FIG. 19 is a side view showing a load-based cooling module according to the present invention in operation, and FIG. 20 is a side view showing the load-based cooling module according to the present invention not in operation.

As shown in FIGS. 19 and 20, the load-based cooling module 200 comprises: a module case 202 attached to the barrier; a motor 204 mounted in the module case 202; a nozzle 206 connected to the motor 204, the nozzle 206 having an inlet communicating with the rapid cooling channel and an outlet 206*a* communicating with the rapid cooling chamber S; and an infrared sensor 208 mounted at a side of the nozzle 206 for scanning the interior of the rapid cooling chamber S to sense the location and the temperature of the load.

The motor 204 operates the nozzle 206 under the control of the controller 210. When the door 106 of the refrigerating chamber R is opened, the operation of the motor 204 is stopped. When the door 106 of the refrigerating chamber R is closed again, the nozzle 206 is rotated by the motor 204, as shown in FIG. 19, so that the infrared sensor 208 scans the interior of the rapid cooling chamber S to sense any load in the rapid cooling chamber S (nozzle rotation mode). When the infrared sensor 208 senses a high-temperature load in the rapid cooling chamber S, the motor 204 stops the rotation of the nozzle 206 the moment that the outlet 206*a* of the nozzle 206 faces the sensed high-temperature load, so that the cool air passing through the nozzle 206 is intensively supplied to the high-temperature load (nozzle intensive supply mode). When the high-temperature load is handled by injection of the cool air through the nozzle 206, the motor 204 rotates the nozzle 206, as shown in FIG. 20, so that the outlet 206*a* of the nozzle 206 is closed by the module case 202 (nozzle off mode).

The nozzle 206 is disposed in such a manner that the outlet 206*a* of the nozzle 206 is projected toward the interior of the rapid cooling chamber S. The nozzle 206 is connected at the center thereof to a shaft of the motor 204 via an additional power transmission device, for example, a gear 209. Alternatively, the nozzle 206 may be connected at the center thereof directly to the shaft of the motor 204.

The infrared sensor 208 comprises a temperature sensing unit for applying an infrared ray to the interior of the rapid cooling chamber S to sense the surface temperature of a load in the rapid cooling chamber S, and a thermistor for sensing the temperature around the load in the rapid cooling chamber S. The real temperature of the load is obtained from the difference between the value of the temperature sensed by the temperature sensing unit and the value of the temperature sensed by the thermistor.

The operation of the refrigerator with the above-stated construction according to the third preferred embodiment of the present invention will now be described.

Figure 21:
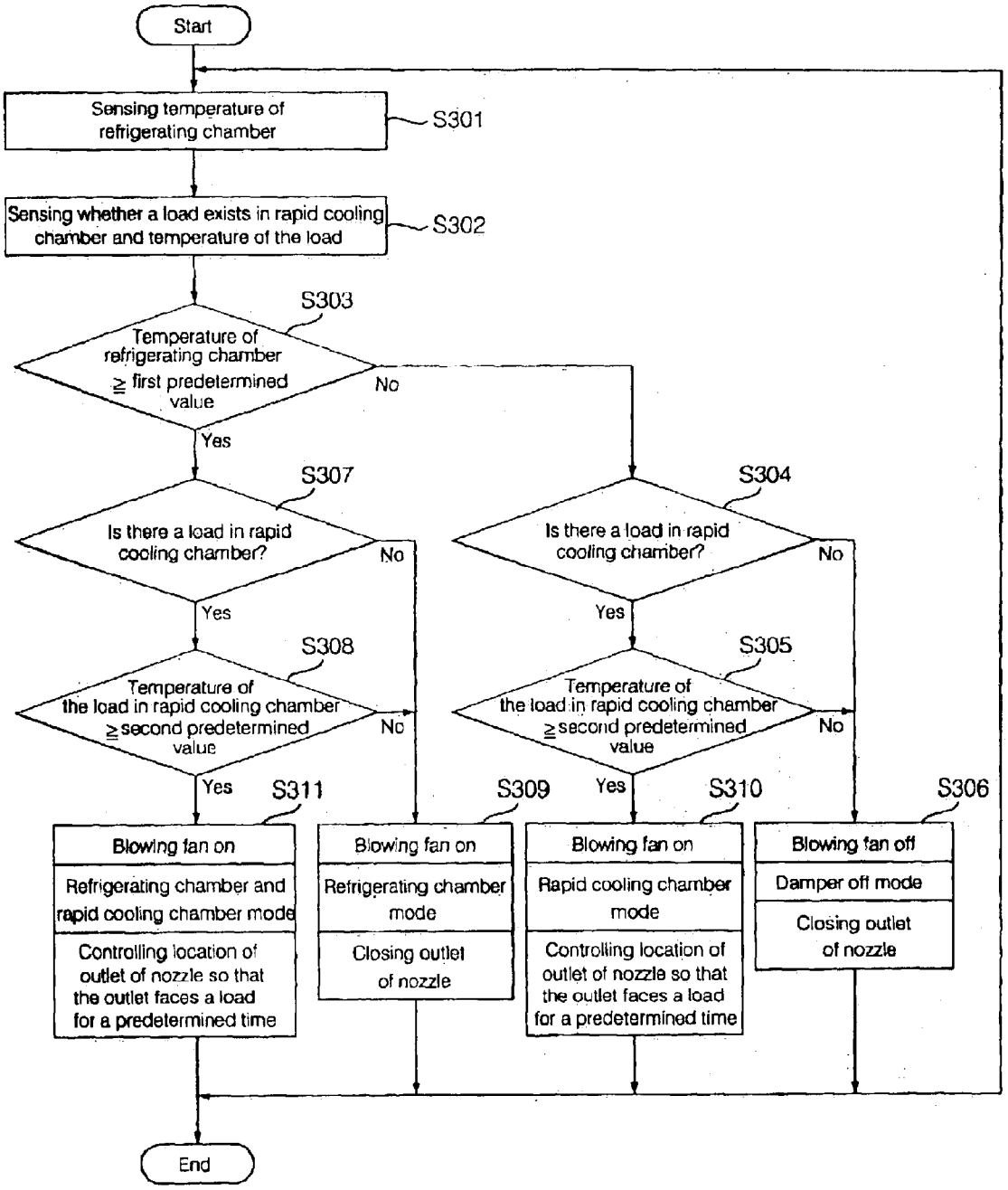
FIG. 21 is a flow chart illustrating a method of controlling the refrigerator according to the third preferred embodiment of the present invention.

FIG. 21 is a flow chart illustrating a method of controlling the refrigerator according to the third preferred embodiment of the present invention.

The load sensing sensor 64 senses the temperature of the freezing chamber F or the refrigerating chamber R (S301).

When the nozzle 206 is rotated by the motor 204 as the door 106 of the refrigerating chamber R is opened and then closed again, the infrared sensor 208 scans the interior of the rapid cooling chamber S to sense the location and the temperature of a load in the rapid cooling chamber S (S302).

The controller 210 stops the operation of the blowing fan 60 (blowing fan off), shifts the damper 62 to the "A" position (damper off mode) so that the cool air is not introduced into the refrigerating chamber R or the rapid cooling chamber S, and enables the motor 204 to rotate the nozzle 206 (nozzle off mode) so that the outlet 206*a* of the nozzle 206 is closed by the module case 202, when the temperature of the freezing chamber F or the refrigerating chamber R sensed by the load sensing sensor 64 is below a first predetermined value, and when the infrared sensor 208 senses no load or the temperature of the load sensed by the infrared sensor 208 is below a second predetermined value (S303, S304, S305, S306).

As time goes by or if the door 106 of the refrigerating chamber R is repeatedly opened, the temperature of the refrigerating chamber R rises.

The controller 210 operates the blowing fan 60 (blowing fan on), shifts the damper 62 to the "B" position (refrigerating chamber mode) so that the cool air is introduced into the refrigerating chamber R, and enables the motor 204 to rotate the nozzle 206 (nozzle off mode) so that the outlet 206*a* of the nozzle 206 is closed by the module case 202, when the temperature of the freezing chamber F or the refrigerating chamber R sensed by the load sensing sensor 64 is not less than the first predetermined value, and when the infrared sensor 208 senses no load or the temperature of the load sensed by the infrared sensor 208 is below the second predetermined value (S303, S307, S308, S309).

The controller 210 operates the compressor 52.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the blowing fan 60 so that the freezing chamber F is maintained at a low temperature, and then returned to the vicinity of the evaporator 58. The remainder of the cool-air surrounding the evaporator 58 is supplied to the refrigerating chamber R via the cool air inlet duct 126 and the damper 62.

The cool air supplied to the refrigerating chamber R is downwardly moved along the refrigerating chamber R to maintain the interior of the refrigerating chamber R at a low temperature below the first predetermined value, and then returned to the vicinity of the evaporator 58 via the cool air outlet duct 128.

When stored goods to be rapidly cooled are put in the rapid cooling chamber S of the refrigerator, a new load exists in the rapid cooling chamber S.

The controller 210 operates the blowing fan 60 (blowing fan on), shifts the damper 62 to the "C" position (rapid cooling chamber mode) so that the cool air is introduced into the rapid cooling chamber S, and enables the motor 204 to stop the rotation of the nozzle 206 the moment that the outlet 206*a* of the nozzle 206 faces the sensed high-temperature load (nozzle intensive supply mode) so that the cool air passing through the nozzle 206 is intensively supplied to the high-temperature load, when the temperature of the freezing chamber F or the refrigerating chamber R sensed by the load sensing sensor 64 is below the first predetermined value, and when the infrared sensor 208 senses a load in the rapid cooling chamber S and the temperature of the load in the rapid cooling chamber S sensed by the infrared sensor 208 is not less than the second predetermined value (S303, S304, S305, S310).

The controller 210 operates the compressor 52.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the blowing fan 60 so that the freezing chamber F is maintained at a low temperature, and then returned to the vicinity of the evaporator 58. The remainder of the cool air surrounding the evaporator 58 is supplied to the rapid cooling chamber S via the cool air inlet duct 126, the damper 62, and the rapid cooling duct 130.

The cool air supplied to the rapid cooling chamber S is intensively supplied to the high-temperature load in the rapid cooling chamber S so that the high-temperature load is rapidly handled, and then guided into the refrigerating chamber R via the cool air guide holes 140*a* and 142*a* formed at the rapid cooling panel 140 and the lid 142, respectively. The cool air guided into the refrigerating chamber R is downwardly moved along the refrigerating chamber R, and then returned to the vicinity of the evaporator 58 via the cool air outlet duct 128.

Stored goods to be rapidly cooled may be put in the rapid cooling chamber S while the temperature of the refrigerating chamber R is high. The controller 210 operates the blowing fan 60 at high speed (blowing fan on), shifts the damper 62 to the "B" position (refrigerating chamber mode) so that the cool air is introduced into the refrigerating chamber R for a first predetermined time (for example, three minutes) and then shifts the damper 62 to the "C" position (rapid cooling chamber mode) so that the cool air is introduced into the rapid cooling chamber S for a second predetermined time (for example, one minute), and enables the motor 204 to stop the rotation of the nozzle 206 the moment that the outlet 206*a* of the nozzle 206 faces the sensed high-temperature load (nozzle intensive supply mode) so that the cool air passing through the nozzle 206 is intensively supplied to the high-temperature load, when the temperature of the refrigerating chamber R sensed by the load sensing sensor 64 is not less than the first predetermined value, and when the infrared sensor 208 senses a load in the rapid cooling chamber S and the temperature of the load in the rapid cooling chamber S sensed by the infrared sensor 208 is not less than the second predetermined value (S303, S307, S308, S311). The refrigerating chamber mode and the rapid cooling chamber mode may be repeatedly switched.

The controller 69 operates the compressor 52.

When the compressor 52 is operated, low-temperature and low-pressure coolant passes through the evaporator 58. As the coolant passes through the evaporator 58, it absorbs heat from air surrounding the evaporator 58 by means of heat transfer between the coolant passing through the evaporator 58 and the air surrounding the evaporator 58. Consequently, the temperature of the air surrounding the evaporator 58 is lowered. Some of the low-temperature air, i.e., the cool air surrounding the evaporator 58 is supplied to the freezing chamber F by the blowing fan 60 so that the freezing chamber F is maintained at a low temperature, and then returned to the vicinity of the evaporator 58. The remainder of the cool air surrounding the evaporator 58 is supplied to the refrigerating chamber R via the cool air inlet duct 126 for the first predetermined time, and then it is supplied to the rapid cooling chamber S via the cool air inlet duct 126 for the second predetermined time.

The cool air supplied to the refrigerating chamber R for the first predetermined time is downwardly moved along the refrigerating chamber R to maintain the interior of the refrigerating chamber R at a low temperature, and then returned to the vicinity of the evaporator 58 via the cool air outlet duct 128. The cool air supplied to the rapid cooling chamber S for the second predetermined time is intensively supplied to the high-temperature load in the rapid cooling chamber S so that the high-temperature load is rapidly handled, and then guided into the refrigerating chamber R via the cool air guide holes 140*a* and 142*a* formed at the rapid cooling panel 140 and the id 142, respectively. The cool air guided into the refrigerating chamber R is downwardly moved along the refrigerating chamber R, and then returned to the vicinity of the evaporator 58 via the cool air outlet duct 128.

When the door of the refrigerating chamber R is not closed after it is opened, the controller 210 controls the compressor 52, the blowing fan 60, the damper 62, and the motor 204 on the basis of the comparison the temperature of the freezing chamber F or the refrigerating chamber R sensed by the load sensing sensor 64 and the first predetermined value.

Specifically, the controller 210 stops the operations of the compressor 52 and the blowing fan 60, shifts the damper 62 to the "A" position (damper off mode), and enables the motor 204 to rotate the nozzle 206 (nozzle off mode) so that the outlet 206*a* of the nozzle 206 is closed by the module case 202, when the temperature of the freezing chamber F or the refrigerating chamber R sensed by the load sensing sensor 64 is below the first predetermined value.

The controller 210 operates the compressor 52 and the blowing fan 60, shifts the damper 62 to the "B" position (refrigerating chamber mode), and enables the motor 204 to rotate the nozzle 206 (nozzle off mode) so that the outlet 206*a* of the nozzle 206 is closed by the module case 202, when the temperature of the freezing chamber F or the refrigerating chamber R sensed by the load sensing sensor 64 is not less than the first predetermined value.

As apparent from the above description, the present invention provides a refrigerator comprising a rapid cooling chamber mounted in at least one of freezing and refrigerating chambers of the refrigerator, a rapid cooling channel having one end communicating with an entering channel of the refrigerating chamber and the other end communicating with the rapid cooling channel, along which cool air supplied to the refrigerating chamber is introduced into the rapid cooling chamber, and a damper for controlling the flow of cool air passing through the entering channel of the refrigerating chamber and the rapid cooling channel, so that loads in the freezing or refrigerating chamber and the rapid cooling chamber is individually handled, thereby rapidly and efficiently cooling stored goods in the freezing or refrigerating chamber and the rapid cooling chamber, and preventing stored goods in a rapid cooling chamber from being excessively cooled.

The refrigerator of the present invention comprises a rapid cooling chamber mounted in a refrigerating chamber of the refrigerator, a rapid cooling channel having one end communicating with a freezing chamber of the refrigerator and the other end communicating with the rapid cooling channel, and a second blowing fan for blowing cool air in the freezing chamber to the rapid cooling chamber so the cool air in the freezing chamber is directly supplied to the rap-d cooling chamber, whereby the structure of the refrigerator is simple.

The refrigerator or the present invention further comprises a load-based cooling module for sensing a load in the rapid cooling chamber and supplying the cool air to the sensed load so that the load in the rapid cooling chamber is intensively cooled, thereby rapidly and efficiently cooling stored goods in the rapid cooling chamber.

The rapid cooling chamber is mounted in the refrigerating chamber of the refrigerator, whereby the rapid cooling chamber is not excessively cooled.

The rapid cooling chamber comprises a rapid cooling panel attached to the freezing chamber or the refrigerating chamber, the rapid cooling panel having a stored goods receiving space defined therein and a stored goods entrance formed at the front part thereof, and a lid pivotably attached to the rapid cooling panel for closing the stored good entrance of the rapid cooling panel. Furthermore, the refrigerator of the present invention further comprises guides for facilitating the attachment of the rapid cooling panel to the freezing chamber or the refrigerating chamber. Consequently, it is possible to selectively provide the rapid cooling chamber in the refrigerator depending upon conveniences of a user or a manufacturer.

In the refrigerator of the present invention is provided a barrier having an entering channel of the refrigerating chamber formed therein, by which the freezing chamber and the refrigerating chamber are separated from each other. In the barrier is also formed the rapid cooling channel. Consequently, the structure of the channel for supplying the cool air to the rapid cooling chamber is simple, and it is easy and simple to form the channel.

The refrigerator of the present invention further comprises an infrared sensor disposed facing the interior of the rapid cooling chamber for sensing a load in the rapid cooling chamber, whereby it is possible to sense whether a load exists in the rapid cooling chamber and sense the temperature of the load when the load exists in the rapid cooling chamber.

Furthermore, the present invention provides a method of controlling a refrigerator comprising the steps of sensing a load in a freezing or refrigerating chamber of the refrigerator, sensing a load in a rapid cooling chamber of the refrigerator, determining whether cool air is to be supplied to the freezing or refrigerating chamber and the rapid cooling chamber on the basis of the sensed results, and controlling a blowing fan and a damper on the basis of the determined result, whereby the supply of cool air is easily controlled, and thus the control of the refrigerator is easy and simple.

The present invention provides a method of controlling a refrigerator comprising the steps of sensing a load in a freezing or refrigerating chamber of the refrigerator, sensing a load in a rapid cooling chamber of the refrigerator, determining whether cool air is to be supplied to the freezing or refrigerating chamber and the rapid cooling chamber on the basis of the sensed results, and controlling a first blowing fan and a second blowing fan on the basis of the determined result, whereby the supply of cool air is easily controlled, and thus the control of the refrigerator is easy and simple.

The present invention provides a method of controlling a refrigerator comprising the steps of sensing a load in a freezing or refrigerating chamber of the refrigerator, sensing a load in a rapid cooling chamber of the refrigerator, determining whether cool air is to be supplied to the freezing or refrigerating chamber and the rapid cooling chamber on the basis of the sensed results and determining the direction of supply of the cool air if it is determined that the cool air is to be supplied to any one of the freezing or refrigerating chamber and the rapid cooling chamber, and controlling a blowing fan, a damper, and a nozzle on the basis of the determined result, whereby the cool air can be directly supplied to the load in the rapid cooling chamber, and the time required to handle the load in the rapid cooling chamber can be minimized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a compressor for compressing coolant;

a condenser for condensing the coolant compressed by the compressor so that heat from the coolant passing through the condenser is emitted to air surrounding the condenser;

an expander for decompressing the coolant condensed by the condenser;

an evaporator for evaporating the coolant expanded by the expander so that the expanded coolant passing through the evaporator absorbs heat from air surrounding the evaporator;

a blowing fan for blowing the air cooled by the evaporator to a freezing chamber of the refrigerator or a refrigerating chamber of the refrigerator and blowing the cool air in the freezing, chamber or the refrigerating chamber to the vicinity of the evaporator so that the cool air is circulated in the refrigerator;

a rapid cooling chamber mounted in at least one of the freezing and refrigerating chambers;

a rapid cooling channel having one end communicating with an entering channel of the refrigerating chamber and the other end communicating with the rapid cooling channel;

a damper for controlling the flow of cool air passing through the entering channel of the refrigerating chamber and the rapid cooling channel;

a load sensing sensor for sensing a load-in the freezing chamber or the refrigerating chamber;

a load-based cooling module for sensing a load in the rapid cooling chamber and supplying the cool air guided along the rapid cooling channel to the sensed load; and a controller for controlling the compressor, the blowing fan, the damper, and the load-based cooling module on the basis of signals outputted from the load sensing sensor and the load-based cooling module.

2. The refrigerator as set forth in claim 1, wherein the rapid cooling chamber comprises:

a rapid cooling panel attached to the freezing chamber or the refrigerating chamber, the rapid cooling panel having a stored goods receiving space defined therein and a stored goods entrance formed at the front part thereof; and a lid pivotably attached to the rapid cooling panel for closing the stored good entrance of the rapid cooling panel.

3. The refrigerator as set forth in claim 2, further comprising guides for facilitating the attachment of the rapid cooling panel to the freezing chamber or the refrigerating chamber.

4. The refrigerator as set forth in claim 1, further comprising a barrier disposed between the freezing chamber and the refrigerating chamber so that the freezing chamber and the refrigerating chamber are separated from each other, the barrier having the entering channel of the refrigerating chamber formed therein, wherein the rapid cooling channel is formed in the barrier.

5. The refrigerator as set forth in claim 1, wherein the load-based cooling module is attached to the barrier while facing the interior of the rapid cooling chamber.

6. The refrigerator as set forth in claim 1, wherein the load-based cooling module comprises:

a module case attached to the barrier;

a motor mounted in the module case;

a nozzle connected to the motor, the nozzle having an inlet communicating with the rapid cooling channel and an outlet communicating with the rapid cooling chamber; and an infrared sensor mounted at a side of the nozzle for scanning the interior of the rapid cooling chamber to sense the location and the temperature of the load.

* * * * *

UNITED STATES PATENT AND TRADEMARK OFFICE

CERTIFICATE OF CORRECTION

PATENT NO. : 6,865,899 B2
DATED : March 15, 2005
INVENTOR(S) : Y. S. Nam et al.

It is certified that error appears in the above-identified patent and that said Letters Patent is hereby corrected as shown below:

Column 22,
Line 10, after "freezing" delete ",".
Line 22, "load-in" should be -- load in --.

Signed and Sealed this

First Day of November, 2005

JON W. DUDAS
*Director of the United States Patent and Trademark Office*